US008400376B2

(12) United States Patent
Saito

(10) Patent No.: US 8,400,376 B2
(45) Date of Patent: Mar. 19, 2013

(54) VOLTAGE SELECTION CIRCUIT, ELECTROPHORETIC DISPLAY APPARATUS, AND ELECTRONIC DEVICE

(75) Inventor: Hidetoshi Saito, Suwa (JP)

(73) Assignee: Seiko Epson Corporation (JP)

( * ) Notice: Subject to any disclaimer, the term of this patent is extended or adjusted under 35 U.S.C. 154(b) by 970 days.

(21) Appl. No.: 12/366,103

(22) Filed: Feb. 5, 2009

(65) Prior Publication Data

US 2009/0237333 A1 Sep. 24, 2009

(30) Foreign Application Priority Data

Mar. 24, 2008 (JP) ..... 2008-076528

(51) Int. Cl.
*G09G 3/30* (2006.01)

(52) U.S. Cl. ..... 345/76; 345/107; 307/80

(58) Field of Classification Search ..... None
See application file for complete search history.

(56) References Cited

U.S. PATENT DOCUMENTS

| | | | | |
|---|---|---|---|---|
| 7,518,782 | B2 * | 4/2009 | Maeda | 359/296 |
| 7,528,828 | B2 * | 5/2009 | Nakajima | 345/211 |
| 2003/0011586 | A1 | 1/2003 | Nakajima | |
| 2004/0169543 | A1 * | 9/2004 | Doutreloigne et al. | 327/333 |
| 2007/0040827 | A1 * | 2/2007 | Toyozawa et al. | 345/211 |
| 2007/0070032 | A1 * | 3/2007 | Chung et al. | 345/107 |
| 2007/0075627 | A1 * | 4/2007 | Kimura et al. | 313/503 |
| 2008/0079001 | A1 * | 4/2008 | Umezaki et al. | 257/59 |
| 2008/0238867 | A1 | 10/2008 | Maeda et al. | |
| 2008/0307240 | A1 * | 12/2008 | Dahan et al. | 713/320 |
| 2009/0237393 | A1 * | 9/2009 | Saito | 345/214 |

FOREIGN PATENT DOCUMENTS

| | | |
|---|---|---|
| JP | 2003-84314 | 3/2003 |
| JP | 2008-268853 | 11/2008 |
| WO | 2005-093704 | 10/2005 |

* cited by examiner

*Primary Examiner* — Joseph Haley
*Assistant Examiner* — Henok Heyi
(74) *Attorney, Agent, or Firm* — Harness, Dickey & Pierce, P.L.C.

(57) ABSTRACT

Provided is a voltage selection circuit for outputting a potential selected from a plurality of input potentials, the voltage selection circuit capable of selectively outputting a first high-level potential being a highest potential, a second high-level potential, or a third high-level potential being a lowest potential from an output terminal thereof. The voltage selection circuit includes a first switching circuit that supplies the first high-level potential to the output terminal, a second switching circuit that supplies the second high-level potential to the output terminal, and a third switching circuit that supplies the third high-level potential to the output terminal. The first switching circuit includes a high-voltage transistor and a level shifter connected to a gate terminal of the high-voltage transistor. The second switching circuit includes a first low-voltage transistor, a level shifter connected to a gate terminal of the first low-voltage transistor, and a diode disposed between the first low-voltage transistor and the output terminal. The third switching circuit includes a second low-voltage transistor and a diode disposed between the second low-voltage transistor and the output terminal.

6 Claims, 16 Drawing Sheets

VOLTAGE SELECTION CIRCUIT, ELECTROPHORETIC DISPLAY APPARATUS, AND ELECTRONIC DEVICE

BACKGROUND

1. Technical Field

The present invention relates to a voltage selection circuit, an electrophoretic display apparatus, and an electronic device.

2. Related Art

One known example of an active-matrix electrophoretic display apparatus is one that includes a switching transistor and a memory circuit (static random access memory (SRAM)) in a pixel (see, for example, JP-A-2003-84314). The display apparatus described in this patent document has a configuration in which a microcapsule incorporating charged particles is attached on a substrate where a switching transistor and a pixel electrode are formed. This configuration displays an image by controlling the charged particles using an electric field generated between the pixel electrode and a common electrode between which the microcapsule is sandwiched.

The present applicant proposes in JP-A-2008-268853 an improvement of the electrophoretic display apparatus described in the above-mentioned JP-A-2003-84314. With this electrophoretic display apparatus, an operation of writing an image signal to a latch circuit and an operation of applying a voltage to an electrophoretic element and displaying an image can be independently controlled. For example, the power supply voltage of the latch circuit can be 5 V in writing an image signal to suppress a load of a driving circuit and power consumption, whereas the power supply voltage of the latch circuit can be 15 V in displaying an image to acquire a high contrast. It is conceivable to use such operations in the electrophoretic display apparatus described in the above-mentioned patent document JP-A-2003-84314.

To use different power supply voltages for a latch circuit in writing an image signal and in displaying an image, as described above, it is necessary to have a voltage selection circuit, as illustrated in FIGS. 18A and 18B, in a power supply system for supplying a power supply voltage to the latch circuit. A voltage selection circuit 641 illustrated in FIG. 18A and a voltage selection circuit 642 illustrated in FIG. 18B are each a circuit that outputs a potential selected from among a high-level driving potential VH (e.g., 15 V), a high-level pixel writing potential VL (e.g., 5 V), and a battery potential VB (e.g., 2 V) from an output terminal Nout.

The voltage selection circuit 641 illustrated in FIG. 18A includes a first switching circuit SC11, a second switching circuit SC12, and a third switching circuit SC13. The first switching circuit SC11 includes a positive channel metal-oxide semiconductor (P-MOS) transistor PM1 and a level shifter LS1. The second switching circuit SC12 includes a P-MOS transistor PM21 and a level shifter LS21. The third switching circuit SC13 includes a P-MOS transistor PM31 and level shifter LS31.

In the voltage selection circuit 641, a high-voltage transistor is, of course, used in the P-MOS transistor PM1. Additionally, because the drain terminal of each of the P-MOS transistor PM1, the P-MOS transistor PM21, and the P-MOS transistor PM31 is connected to a common output line DL (output terminal Nout), a high-voltage transistor is also used in each of the P-MOS transistor PM21 and the P-MOS transistor PM31 to prevent the entry of a high-level driving potential VH output from the first switching circuit SC11. Furthermore, it is also necessary to use a high-voltage transistor in each of the level shifter LS21 connected to the gate terminal of the P-MOS transistor PM21 and the level shifter LS31 connected to the gate terminal of the P-MOS transistor PM31 to supply the high-level driving potential VH to the gate terminal of each of the P-MOS transistor PM21 and the P-MOS transistor PM31.

The voltage selection circuit 642 illustrated in FIG. 18B includes the first switching circuit SC11, which is the same as that used in the voltage selection circuit 641, a second switching circuit SC22, and a third switching circuit SC23. The second switching circuit SC22 includes an negative channel MOS (N-MOS) transistor NM1 and the level shifter LS21. The third switching circuit SC23 includes an N-MOS transistor NM2 and a level shifter LS32.

In the voltage selection circuit 642, in which each of the second switching circuit SC22 and the third switching circuit SC23 includes an N-MOS transistor, it is also necessary to use a high-level transistor in each of the N-MOS transistor NM1 and the N-MOS transistor NM2 to prevent the entry of the high-level driving potential VH output from the first switching circuit SC11. In contrast, because it is only necessary that the gate-source voltage (Vgs) of the N-MOS transistor NM2 be a predetermined voltage higher than a threshold voltage, the level shifter LS32 in the third switching circuit SC23 can be one that raises the battery potential VB to the high-level pixel writing voltage VL, for example. Accordingly, a low-voltage transistor of approximately 5 to 6 V can be used in the level shifter LS32. The circuitry area of the voltage selection circuit 642 can be smaller, although slightly, than that of the voltage selection circuit 641 illustrated in FIG. 18A.

As described above, both when a P-MOS transistor is used in a switching element and when an N-MOS transistor is used therein, a plurality of high-voltage transistors is necessary, and this presents a problem of a large circuitry area. In addition, because a high-voltage transistor causes a large leakage current, the high-voltage transistor is disadvantageous in terms of power consumption. Furthermore, such a large-size high-voltage transistor may restrict a circuitry layout.

SUMMARY

An advantage of some aspects of the invention is that it provides a voltage selection circuit capable of having a reduced circuitry area and suppressing a leakage current and also provides an electrophoretic display apparatus including the same.

According to a first aspect of the invention, a voltage selection circuit for outputting a potential selected from a plurality of input potentials, the voltage selection circuit capable of selectively outputting a first high-level potential being a highest potential, a second high-level potential, or a third high-level potential being a lowest potential from an output terminal thereof is provided. The voltage selection circuit includes a first switching circuit that supplies the first high-level potential to the output terminal, a second switching circuit that supplies the second high-level potential to the output terminal, and a third switching circuit that supplies the third high-level potential to the output terminal. The first switching circuit includes a high-voltage transistor and a level shifter connected to a gate terminal of the high-voltage transistor. The second switching circuit includes a first low-voltage transistor, a level shifter connected to a gate terminal of the first low-voltage transistor, and a diode disposed between the first low-voltage transistor and the output terminal. The third switching circuit includes a second low-voltage transistor and a diode disposed between the second low-voltage transistor and the output terminal.

With this configuration, because the second and third switching circuits include the respective diodes, the number of high-voltage transistors used can be reduced, and the circuitry area and leakage current can be reduced. First, in the second and third switching circuits, the first high-level potential can be blocked by the respective diodes. Accordingly, there is no need to use a high-voltage transistor in the second and third switching circuits. Each of the second and third switching circuits, which is constructed using a low-voltage transistor, has a reduced circuitry area. Because only the third high-level potential, which is the lowest voltage, is input to the second low-voltage transistor of the third switching circuit, it is not necessary to have a level shifter in the third switching circuit, and the circuitry area can be reduced correspondingly. In addition, because the leakage current in a low-voltage transistor is smaller than that in a high-voltage transistor, the voltage selection circuit according to an aspect of the invention, which uses a low-voltage transistor instead of a high-voltage transistor, the leakage current in circuitry as a whole can be reduced. Moreover, because small-size low-voltage transistors and diodes are used in combination, layout is easy and the number of man-hours therefor can also be reduced.

It is preferable that the level shifter included in the second switching circuit may include a low-voltage transistor. In the second switching circuit, the diode obviates the necessity to input the first high-level potential to the gate terminal of the first low-voltage transistor. Accordingly, the level shifter in the second switching circuit can be constructed using a low-voltage transistor. Therefore, the size of the level shifter in the second switching circuit can be reduced, and the circuitry area can be reduced.

According to a second aspect of the invention, an electrophoretic display apparatus includes two substrates, an electrophoretic element containing an electrophoretic particle and being sandwiched between the two substrates, and a display portion including a plurality of pixels. Each of the pixels includes a pixel electrode, a pixel switching element, and a latch circuit connected between the pixel electrode and the pixel switching element. At least a power supply voltage of the latch circuit is supplied from the above-described voltage selection circuit. With this configuration, because the voltage selection circuit having a small circuitry area and low power consumption is included, the electrophoretic display apparatus can achieve high functionality while complication of the control circuit and an increase in power consumption are suppressed.

It is preferable that the third high-level potential be a voltage of a battery in a power supply system of the electrophoretic display apparatus. With this configuration, because the battery voltage is supplied directly to the latch circuit, the latch circuit can be operated using a simple circuit.

According to a third aspect of the invention, an electronic device includes the above-described electrophoretic display apparatus. With this configuration, the electronic device having low power consumption in the power supply system and also having the high-functionality electrophoretic display portion can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
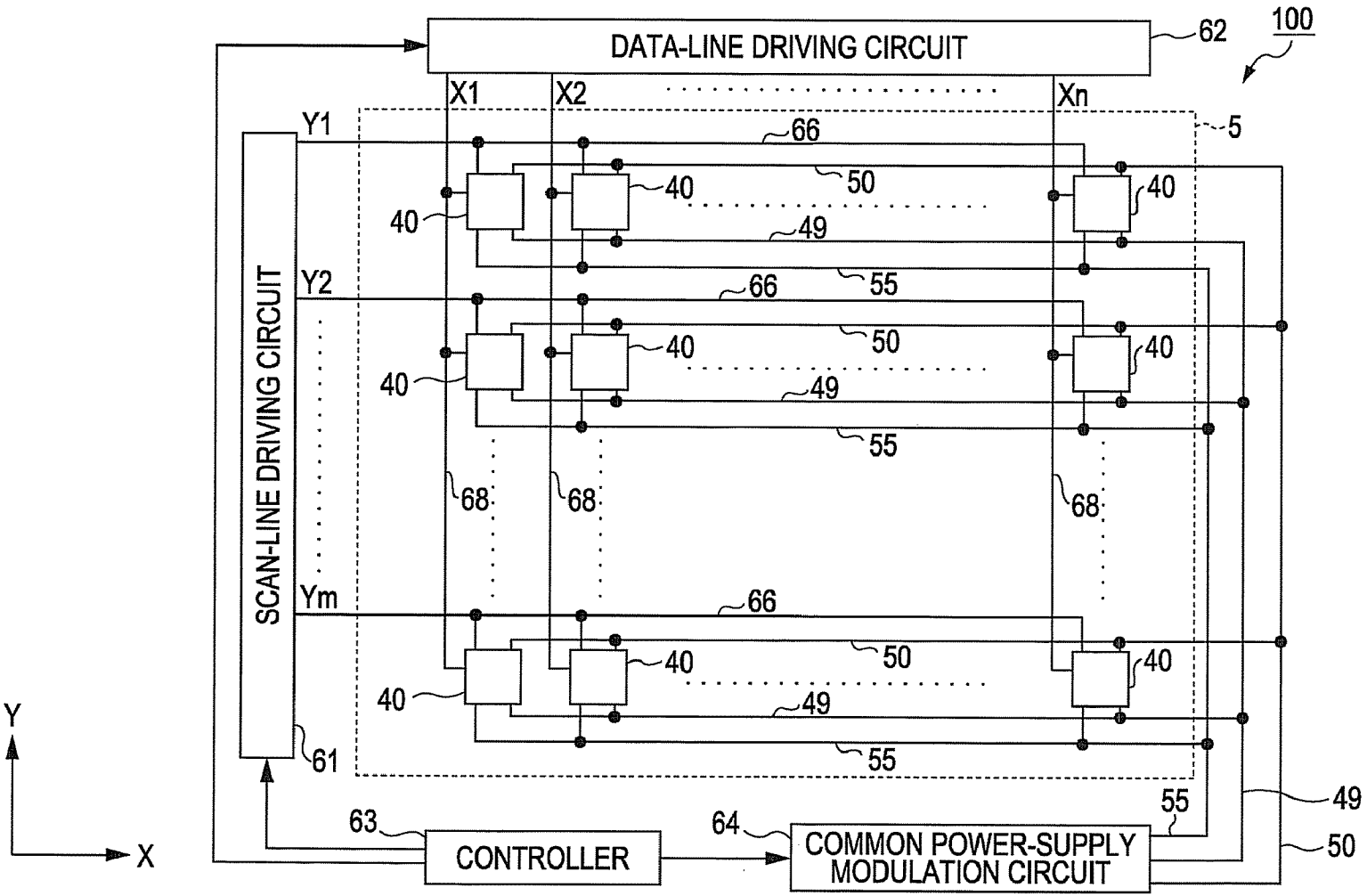
FIG. 1 illustrates a schematic configuration of an electrophoretic display apparatus according to a first embodiment of the invention.

An active-matrix electrophoretic display apparatus according to one embodiment of the invention is described below with reference to the drawings. The invention is not intended to be limited to the present embodiment, which indicates one aspect of the invention. The present embodiment can be freely changed within the technical scope of the invention. For the sake of clarity for each configuration, the scale and the number of structures in the drawings are different from those in actual structures.

FIG. 1 illustrates a schematic configuration of an electrophoretic display apparatus 100 according to the present embodiment. The electrophoretic display apparatus 100 includes a display section 5 in which a plurality of pixels 40 are arranged in a matrix. A scan-line driving circuit 61, a data-line driving circuit 62, a controller (control unit) 63, and a common power-supply modulation circuit 64 are disposed in the vicinity of the display section 5. The scan-line driving circuit 61, the data-line driving circuit 62, and the common power-supply modulation circuit 64 are connected to the controller 63. The controller 63 controls the above-mentioned components on the basis of image data and a synchronization signal supplied from a higher-level apparatus. In the display section 5, a plurality of scan lines 66 extending from the scan-line driving circuit 61 and a plurality of data lines 68 extending from the data-line driving circuit 62 are disposed, and the pixels 40 are disposed so as to correspond to the intersections of the scan lines 66 and the data lines 68.

The scan-line driving circuit 61 is connected to the pixels 40 with the m scan lines 66 (Y1, Y2, . . . , Ym) disposed therebetween. The scan-line driving circuit 61 sequentially selects the scan lines 66 from a 1st to mth row under the control of the controller 63 and supplies a selection signal defining the time of turning on a driving thin-film transistor (TFT) 41 (see FIG. 2) disposed in a corresponding pixel 40 through a selected scan line 66.

The data-line driving circuit 62 is connected to the pixels 40 with the n data lines 68 (X1, X2, . . . , Xn) disposed therebetween and supplies an image signal defining 1-bit pixel data corresponding to each of the pixels 40 to the pixel 40 under the control of the controller 63. In the present embodiment, for defining pixel data '0', a low-level (L) image signal is supplied to the pixel 40, whereas for defining pixel data '1', a high-level (H) image signal is supplied to the pixel 40.

In the display section 5, a low-potential power-supply line 49, a high-potential power-supply line 50, and a common-electrode line 55 extending from the common power-supply modulation circuit 64 are disposed. These lines are connected to the pixels 40. The common power-supply modulation circuit 64 generates various signals to be supplied to each of the above-mentioned lines under the control of the controller 63 and electrically connects and disconnects the lines (makes impedance high).

Figure 2:
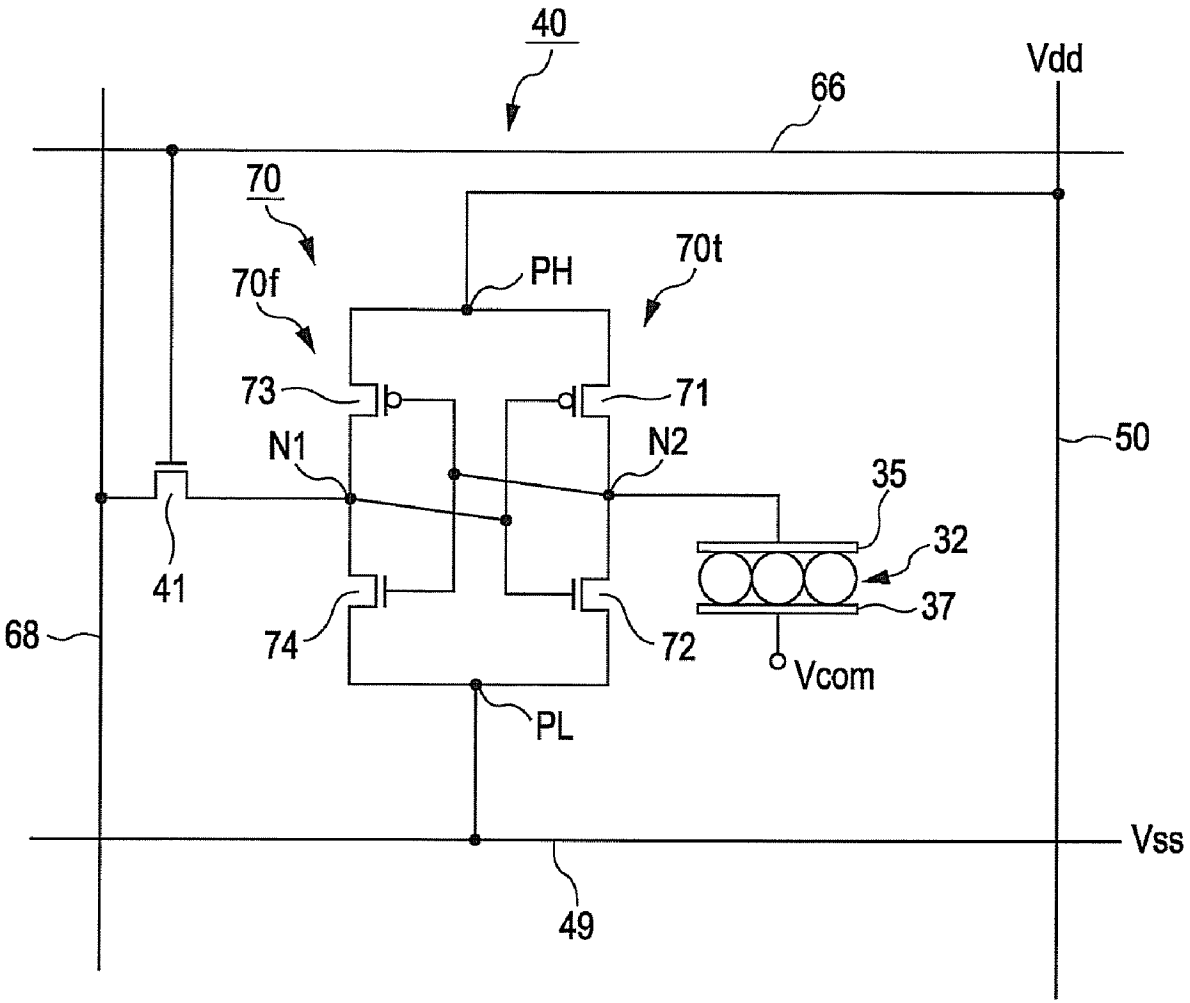
FIG. 2 is a schematic circuit diagram of a pixel of the electrophoretic display apparatus according to the first embodiment.

FIG. 2 illustrates a schematic circuit diagram of the pixel 40. The pixel 40 includes the driving TFT (pixel switching element) 41, a latch circuit (memory circuit) 70, an electrophoretic element 32, a pixel electrode 35, and a common electrode 37. The scan line 66, the data line 68, the low-potential power-supply line 49, and the high-potential power-supply line 50 are arranged so as to surround the above-mentioned components. The pixel 40 has a static random access memory (SRAM) configuration in which an image signal is retained as a potential by use of the latch circuit 70.

The driving TFT 41 is a pixel switching element including a negative channel metal-oxide semiconductor (N-MOS) transistor. The driving TFT 41 has a gate terminal connected to the scan line 66, a source terminal connected to the data line 68, and a drain terminal connected to a data input terminal N1 of the latch circuit 70. A data output terminal N2 of the latch circuit 70 is connected to the pixel electrode 35. The electrophoretic element 32 is sandwiched between the pixel electrode 35 and the common electrode 37. The pixel 40 drives the electrophoretic element 32 using an electric field generated by a potential difference between a potential input from the latch circuit 70 to the pixel electrode 35 and a common electrode potential Vcom input to the common electrode 37 through the common-electrode line 55 (FIG. 1) to display an image.

The latch circuit 70 includes a transfer inverter 70*t* and a feedback inverter 70*f*. A power supply voltage is supplied to each of the transfer inverter 70*t* and the feedback inverter 70*f* from the high-potential power-supply line 50 connected thereto through a high-potential power-supply terminal PH and from the low-potential power-supply line 49 connected thereto through a low-potential power-supply terminal PL. Each of the transfer inverter 70*t* and the feedback inverter 70*f* is a complementary MOS (C-MOS) inverter, and they have a loop structure in which an input terminal of one inverter is connected to an output terminal of the other inverter.

The transfer inverter 70*t* includes a positive channel MOS (P-MOS) transistor 71 and an N-MOS transistor 72. The drain terminal of each of the P-MOS transistor 71 and the N-MOS transistor 72 is connected to the data output terminal N2. The source terminal of the P-MOS transistor 71 is connected to the high-potential power-supply terminal PH. The source terminal of the N-MOS transistor 72 is connected to the low-potential power-supply terminal PL. The gate terminal (input terminal of the transfer inverter 70*t*) of each of the P-MOS transistor 71 and the N-MOS transistor 72 is connected to the data input terminal N1 (output terminal of the feedback inverter 70*f*).

The feedback inverter 70*f* includes a P-MOS transistor 73 and an N-MOS transistor 74. The drain terminal of each of the P-MOS transistor 73 and the N-MOS transistor 74 is connected to the data input terminal N1. The gate terminal (input terminal of the feedback inverter 70*f*) of each of the P-MOS transistor 73 and the N-MOS transistor 74 is connected to the data output terminal N2 (output terminal of the transfer inverter 70*t*).

When the latch circuit 70 retains a high-level (H) image signal (pixel data '1'), the latch circuit 70 outputs a low-level (L) signal from the data output terminal N2. When the latch circuit 70 retains a low-level (L) image signal (pixel data '0'), the latch circuit 70 outputs a high-level (H) signal from the data output terminal N2.

Figure 3:
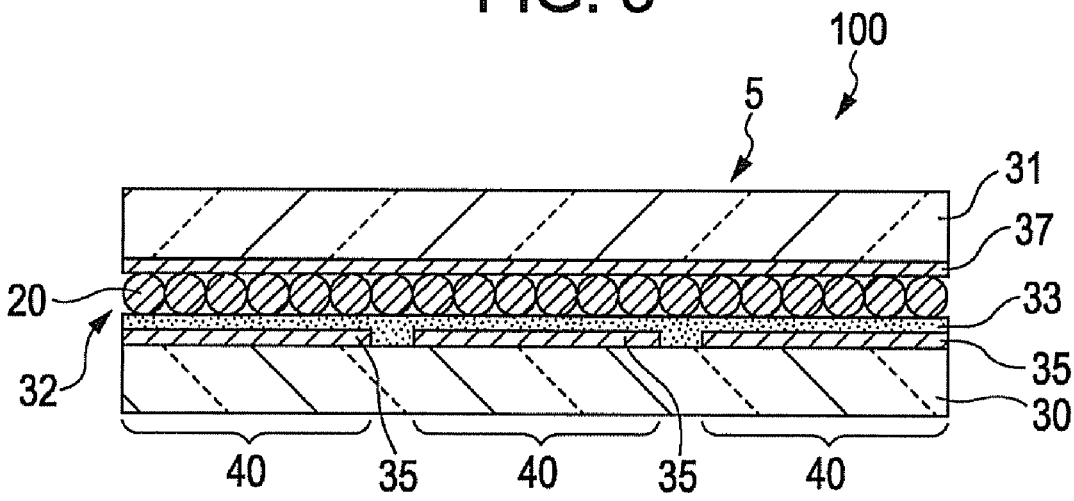
FIG. 3 is a schematic cross-sectional view of the electrophoretic display apparatus according to the first embodiment.

FIG. 3 is a partial cross-sectional view of the electrophoretic display apparatus 100 and illustrates the display section 5. The electrophoretic display apparatus 100 has a configuration in which the electrophoretic element 32 formed from a plurality of microcapsules 20 arranged therein is sandwiched between an element substrate 30 and an opposite substrate 31. In the display section 5, the plurality of pixel electrodes 35 are disposed on the element substrate 30 adjacent to the electrophoretic element 32. The electrophoretic element 32 is bonded to the pixel electrodes 35 with an adhesive layer 33 disposed therebetween.

The element substrate 30 is a substrate made of glass, plastic, or other material and may be opaque because the element substrate 30 is disposed opposite to the image display surface. Each of the pixel electrodes 35 can be an electrode formed from nickel plating and gold plating laminated in this order on copper foil or can be an electrode made of aluminum, indium tin oxide (ITO), or other material. Although not illustrated in FIG. 3, the scan line 66, the data line 68, the driving TFT 41, the latch circuit 70, and other components, which are illustrated in FIGS. 1 and 2, are disposed between the pixel electrode 35 and the element substrate 30.

The opposite substrate 31 is a substrate made of glass, plastic, or other material and allows light to transmit therethrough because it is disposed adjacent to the image display side. The planar common electrode 37 facing the plurality of pixel electrodes 35 is disposed on the opposite substrate 31 adjacent to the electrophoretic element 32. The electrophoretic element 32 is disposed on the common electrode 37. The common electrode 37 is a light-transmitting electrode made of, for example, magnesium silver (MgAg), ITO, or indium zinc oxide (IZO).

The electrophoretic element 32 is formed in advance adjacent to the opposite substrate 31. They and the adhesive layer 33 are typically handled as an electrophoretic sheet. In a manufacturing process, the electrophoretic sheet is handled in the state where a protective detachable sheet is attached on the surface of the adhesive layer 33. The detachable sheet is peeled from the electrophoretic sheet, and the electrophoretic sheet without the detachable sheet is attached to the separately manufactured element substrate 30 (in which various circuits are formed), thus forming the display section 5. Accordingly, the adhesive layer 33 is disposed adjacent to only the pixel electrodes 35.

Figure 4:
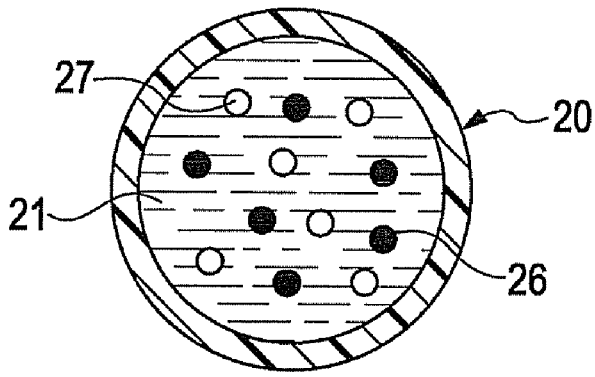
FIG. 4 illustrates a schematic configuration of a microcapsule.

FIG. 4 is a schematic cross-sectional view of one of the microcapsules 20. The microcapsule 20 can have a particle diameter of, for example, approximately 30 to 50 μm. The microcapsule 20 is a conglobation in which a dispersion medium 21, a plurality of white particles (electrophoretic particles) 27, and a plurality of black particles (electrophoretic particles) 26 are encapsulated. The microcapsule 20 is sandwiched between the common electrode 37 and the pixel electrodes 35, as illustrated in FIG. 3. One or more microcapsules 20 are arranged within a single pixel 40.

An outer casing (wall film) of each of the microcapsules 20 can be made using, for example, acrylic resin, such as polymethyl methacrylate or polyethyl methacrylate, urea resin, translucent polymeric resin, such as gum arabic. The dispersion medium 21 is a liquid for dispersing the white particles 27 and the black particle 26 in the microcapsule 20. Examples of the dispersion medium 21 may include water, an alcohol solvent (e.g., methanol, ethanol, isopropanol, butanol, octanol, methyl cellosolve), esters (e.g., ethyl acetate, butyl acetate), ketones (e.g., acetone, methyl ethyl ketone, methyl isobutyl ketone), aliphatic hydrocarbons (e.g., pentane, hexane, octane), alicyclic hydrocarbons (e.g., cyclohexane, methylcyclohexane), aromatic hydrocarbons (e.g., benzene, toluene, benzenes having a long-chain alkyl group (xylene, hxylbenzene, heptylbenzene, octylbenzene, nonylbenzene, decylbenzene, undecylbenzene, dodecylbenzene, tridecylbenzene, tetradecylbenzene)), halogenated hydrocarbons (e.g., methylene chloride, chloroform, carbon tetrachloride, 1,2-dichloroethane), carboxylates, and other oils. These materials can be used either alone or in combination forming a mixture. Additionally, a surface-active agent may also be mixed therein.

The white particles 27 can be particles (polymer or colloid) containing white pigment, such as titanium dioxide, zinc oxide, or antimony trioxide, and are used while being negatively charged, for example. The black particles 26 can be particles (polymer or colloid) containing black pigment, such as aniline black or carbon black, and are used while being positively charged, for example. The pigments may include an additive, such as a charge control agent containing particles of, for example, an electrolyte, a surface-active agent, metallic soap, resin, rubber, oil, varnish, or a compound, a dispersing agent, such as a titanium coupling agent, an aluminum coupling agent, or a silane coupling agent, a lubricant, and a stabilizer, when necessary. In place of the black particles 26 and the white particles 27, red, green, blue, and other color pigments may also be used, for example. With this configuration, red, green, blue, and other colors can be displayed in the display section 5.

Figure 5A:
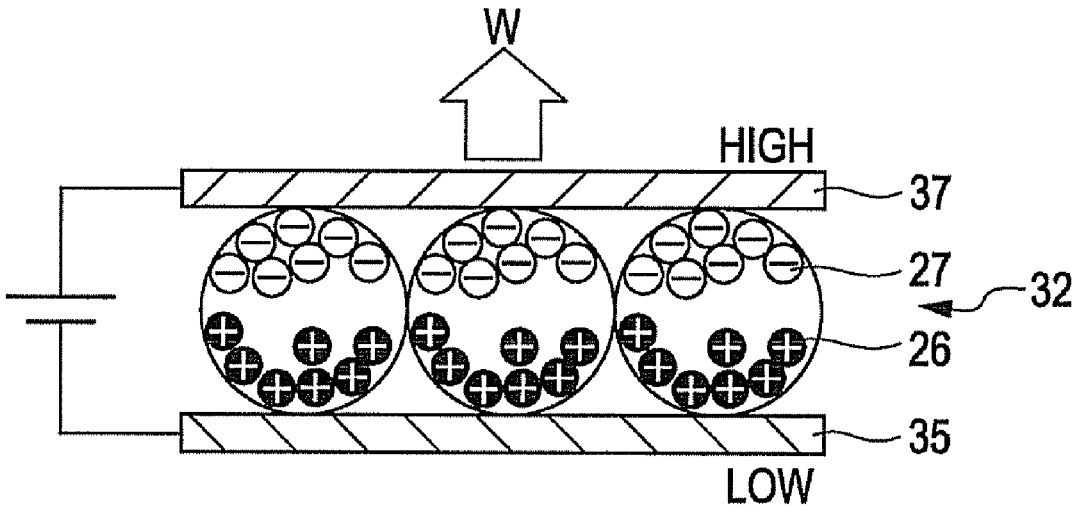
FIGS. 5A and 5B illustrate how the electrophoretic display apparatus operates.
Figure 5B:
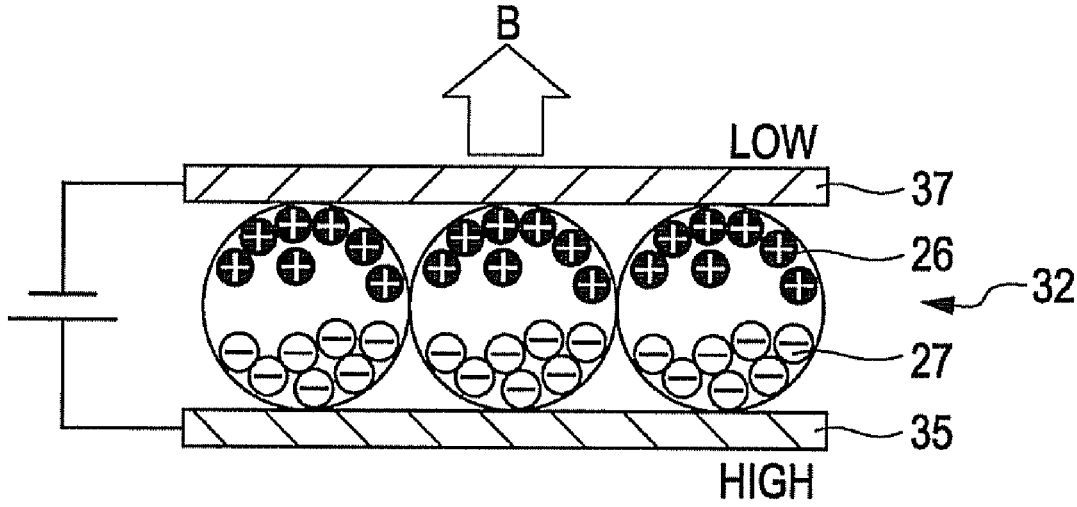

FIGS. 5A and 5B illustrate behavior of the electrophoretic element. FIG. 5A illustrates performance of white display in the pixels 40; FIG. 5B illustrates performance of black display in the pixels 40. In the electrophoretic display apparatus 100, an image signal is input to the data input terminal N1 of the latch circuit 70 through the driving TFT 41 and stored as a potential in the latch circuit 70. Thus, a potential corresponding to the image signal is input from the data output terminal N2 of the latch circuit 70 to the pixel electrode 35 and, as illustrated in FIGS. 5A and 5B, each of the pixels 40 is subjected to white or black display based on a potential difference between the pixel electrode 35 and the common electrode 37.

In the case of white display, as illustrated in FIG. 5A, the common electrode 37 is maintained at a relatively high potential, whereas the pixel electrode 35 is maintained at a relatively low potential. Thus, the negatively charged white particles 27 are attracted toward the common electrode 37, whereas the positively charged black particles 26 are attracted toward the pixel electrode 35. As a result, when the pixel is viewed from the common electrode 37 side, which is the display surface side, white (W) is recognized. In the case of black display, as illustrated in FIG. 5B, the common electrode 37 is maintained at a relatively low potential, whereas the pixel electrode 35 is maintained at a relatively high potential. Thus, the positively charged black particles 26 are attracted toward the common electrode 37, whereas the negatively charged white particles 27 are attracted toward the pixel electrode 35. As a result, when the pixel is viewed from the common electrode 37 side, black (B) is recognized.

Control Unit

Figure 6:
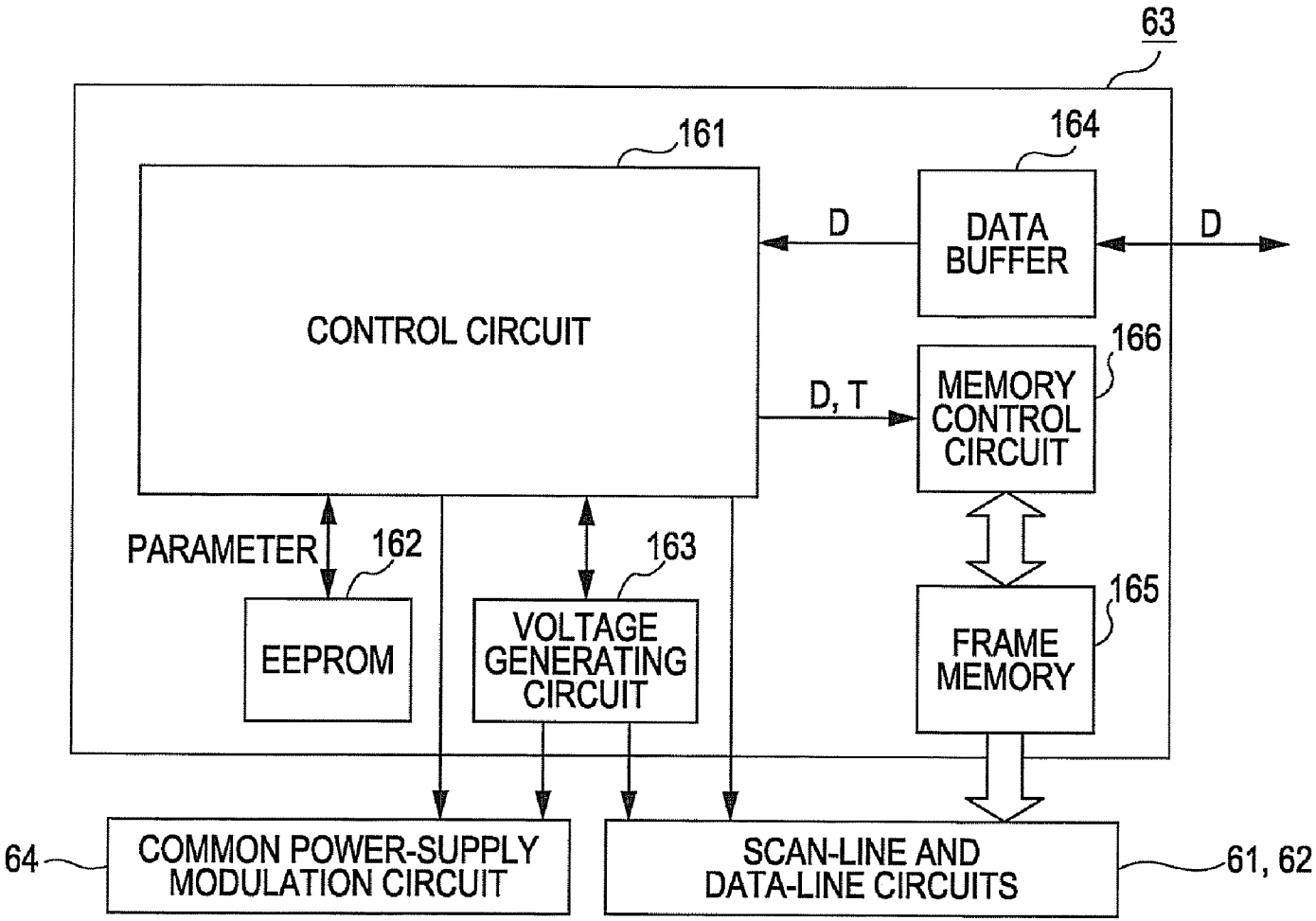
FIG. 6 illustrates a controller of the electrophoretic display apparatus according to the first embodiment.

FIG. 6 is a block diagram that illustrates the controller 63 included in the electrophoretic display apparatus 100. The controller 63 includes a control circuit 161 serving as a central processing unit (CPU), an electrically erasable and programmable read-only memory (EEPROM; memory portion) 162, a voltage generating circuit 163, a data buffer 164, a frame memory 165, and a memory control circuit 166.

The control circuit 161 generates control signals (timing pulses), such as a clock signal CLK, a horizontal synchronization signal Hsync, and a vertical synchronization signal Vsync, and supplies these control signals to circuits disposed in the vicinity of the control circuit 161. The EEPROM 162 stores set values (a mode set value and a volume value) necessary for control of operations of each circuit performed by the control circuit 161. For example, set values of a driving sequence for each operation mode are stored as a look up table (LUT). The EEPROM 162 can also store preset image data for use in displaying an operation status of the electrophoretic display apparatus. The voltage generating circuit 163 is a circuit that supplies a driving voltage to the scan-line driving circuit 61, the data-line driving circuit 62, and the common power-supply modulation circuit 64. The data buffer 164 is an interface in the controller 63 to a higher-level apparatus. The data buffer 164 retains image data D input from the higher-level apparatus and transmits the image data D to the control circuit 161.

The frame memory 165 is a memory that is freely readable and writable and that has a memory space corresponding to an arrangement of the pixels 40 in the display section 5. The memory control circuit 166 expands the image data D supplied from the control circuit 161 in accordance with the pixel arrangement in response to the control signal and writes it into the frame memory 165. The frame memory 165 sequentially transmits a data series composed of the stored image data D to the data-line driving circuit 62 as the image signal. The data-line driving circuit 62 latches the image signal transmitted from the frame memory 165 on a line by line basis in accordance with the control signal supplied from the control circuit 161. In synchronization with a sequential selection operation of the scan lines 66 performed by the scan-line driving circuit 61, the latched image signal is supplied to the data line 68.

Figure 7A:
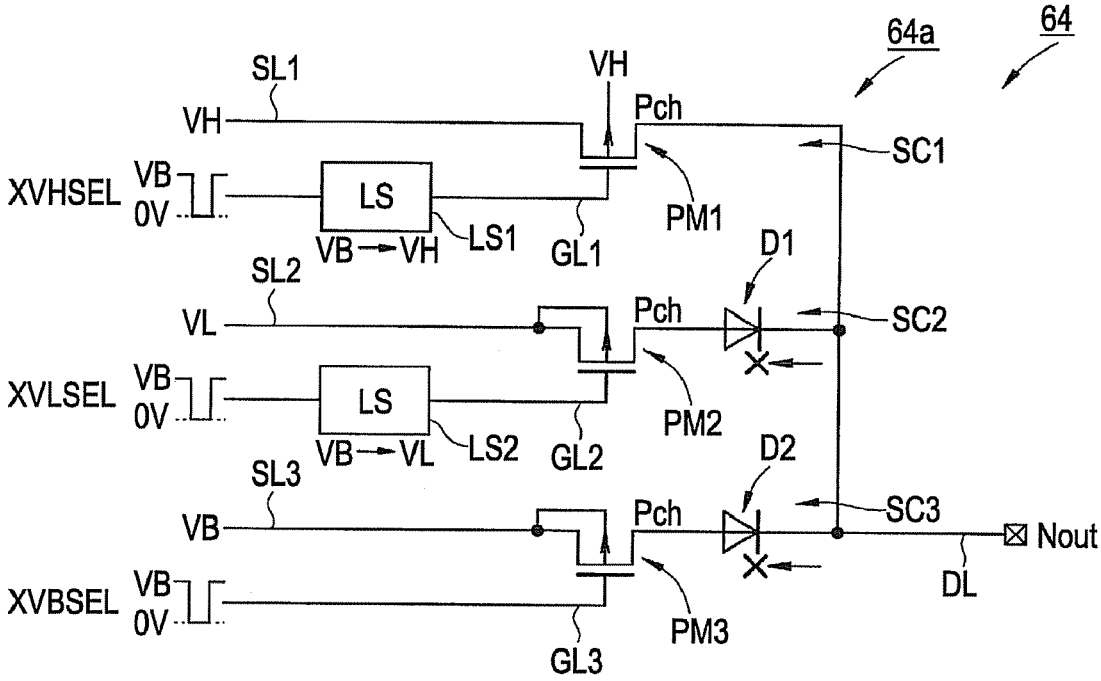
FIGS. 7A and 7B are circuit diagrams of a voltage selection circuit.
Figure 7B:
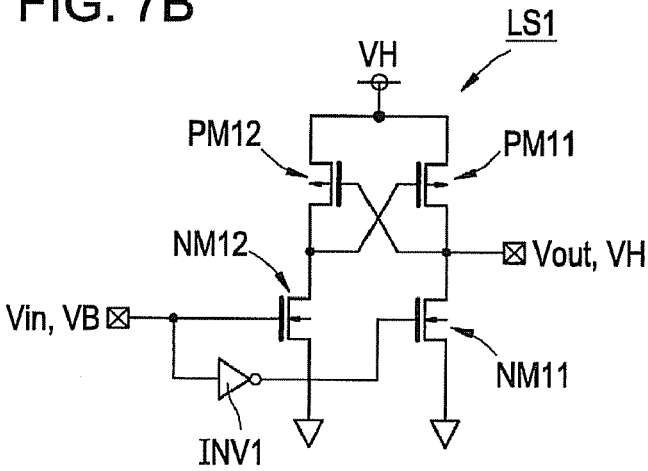

In the electrophoretic display apparatus 100 according to the present embodiment, the common power-supply modulation circuit 64 includes a voltage selection circuit 64*a* for supplying a power supply potential Vdd to the high-potential power-supply line 50 while selecting the power supply potential Vdd from among a plurality of power supply potentials. FIG. 7A illustrates a schematic circuit diagram of the voltage selection circuit 64*a*. FIG. 7B illustrates a schematic circuit diagram of a level shifter LS1 included in the voltage selection circuit 64*a*.

As illustrated in FIG. 7A, the voltage selection circuit 64*a* includes a first switching circuit SC1, a second switching circuit SC2, and a third switching circuit SC3. The first switching circuit SC1 switches an output of a high-level driving potential VH (first high-level potential; for example, 15 V) input through a first input line SL1. The second switching circuit SC2 switches an output of a high-level pixel writing potential VL (second high-level potential; for example, 5 V) input through a second input line SL2. The third switching circuit SC3 switches an output of a battery potential VB (third high-level potential; for example, 2 V) input through a third input line SL3. The first to third switching circuits SC1 to SC3 are connected to an output terminal Nout through an output line DL.

The first switching circuit SC1 includes a P-MOS transistor PM1 and the level shifter LS1. The P-MOS transistor PM1 includes a source terminal connected to the first input line SL1, a drain terminal connected to the output line DL, and a gate terminal connected to the level shifter LS1 through a gate line GL1.

Switching in the first switching circuit SC1 is controlled by an input of a switching signal XVHSEL. When a pulse of a ground potential (0 V; low level) is input to the gate terminal of the P-MOS transistor PM1 as the switching signal XVHSEL, the P-MOS transistor PM1 is turned on, the first input line SL1 and the output line DL are electrically connected to each other, and the high-level driving potential VH is output to the output terminal Nout. The level shifter LS1 generates a high-level potential for maintaining an off state of the P-MOS transistor PM1. That is, the level shifter LS1 raises the battery potential VB being a power supply potential of the control circuit to the high-level driving potential VH and supplies it to the gate line GL1.

The level shifter LS1 can have a circuit configuration illustrated in FIG. 7B, for example, and amplifies the amplitude of a signal input from an input terminal Vin and outputs it to an output terminal Vout. The level shifter LS1 includes P-MOS transistors PM11 and PM12 each having a source terminal connected to the high-potential power supply (high-level driving potential VH) and N-MOS transistors NM11 and NM12 each having a source terminal connected to the low-potential power supply (ground potential GND). The P-MOS transistor PM11 includes a drain terminal connected to the drain terminal of the N-MOS transistor NM11, the gate terminal of the P-MOS transistor PM12, and the output terminal Vout. The P-MOS transistor PM12 includes a drain terminal connected to the drain terminal of the N-MOS transistor NM12 and the gate terminal of the P-MOS transistor PM11. An input signal from the input terminal Vin is input to the gate terminal of the N-MOS transistor NM12, and an input signal inverted by an inverter INV1 is input to the gate terminal of the N-MOS transistor NM11. The level shifter LS1 outputs a high potential input (high-level driving potential VH) through the P-MOS transistor PM11 and a low potential (ground potential GND) input through the N-MOS transistor NM11 as a high level and a low level, respectively.

The second switching circuit SC2 includes a P-MOS transistor PM2, a level shifter LS2, and a diode D1. The P-MOS transistor PM2 includes a source terminal connected to the second input line SL2, a drain terminal connected to the output line DL through the diode D1, and a gate terminal connected to the level shifter LS2 through a gate line GL2. The diode D1 is connected from the P-MOS transistor PM2 toward the output line DL in a forward direction.

Switching in the second switching circuit SC2 is controlled by an input of a switching signal XVLSEL. When a pulse of a ground potential (0 V; low level) is input to the gate terminal of the P-MOS transistor PM2 as the switching signal XVLSEL, the P-MOS transistor PM2 is turned on, the second input line SL2 and the output line DL are electrically connected to each other, and the high-level pixel writing potential VL is output to the output terminal Nout through the diode D1. The level shifter LS2 generates a high-level potential for maintaining an off state of the P-MOS transistor PM2. That is, the level shifter LS2 raises the battery potential VB to the high-level pixel writing potential VL and supplies it to the gate line GL2. A specific configuration of the level shifter LS2 is similar to that of the level shifter LS1 illustrated in FIG. 7B, except that the high-level pixel writing potential VL is supplied from the high-potential power supply of the level shifter LS2. Accordingly, a high-voltage transistor having a breakdown voltage of 10 V or above is not necessary as the transistors included in the level shifter LS2, and each of the transistors included in the level shifter LS2 can be a low-voltage transistor of approximately 5 to 6 V.

The third switching circuit SC3 includes a P-MOS transistor PM3 and a diode D2. The P-MOS transistor PM3 includes a source terminal connected to the third input line SL3, a drain terminal connected to the output line DL through the diode D2, and a gate terminal connected to a gate line GL3. The diode D2 is connected from the P-MOS transistor PM3 toward the output line DL in a forward direction.

Switching in the third switching circuit SC3 is controlled by an input of a switching signal XVBSEL. When a pulse of a ground potential (0 V; low level) is input to the gate terminal of the P-MOS transistor PM3 as the switching signal XVBSEL, the P-MOS transistor PM3 is turned on, the third input line SL3 and the output line DL are electrically connected to each other, and the battery potential VB is output to the output terminal Nout through the diode D2. The third switching circuit SC3 includes no level shifter connected to the gate line GL3.

Because the voltage selection circuit 64*a* having the above-described configuration includes the diode D1 in the second switching circuit SC2 and the diode D2 in the third switching circuit SC3, the number of high-voltage transistors used can be reduced and a reduction in circuitry area and in leakage current can be achieved. First, because the second switching circuit SC2 and the third switching circuit SC3 can prevent the entry of the high-level driving potential VH output from the first switching circuit SC1 using the diode D1 and the diode D2, respectively, it is not necessary to use a high-voltage transistor in the P-MOS transistors PM2 and PM3. Accordingly, the P-MOS transistors PM2 and PM3 can be constructed using a low-voltage transistor sufficient to withstand the high-level pixel writing potential VL (e.g., 5 V), so the size of each of the transistors can be reduced.

Additionally, because it is not necessary to prevent the entry of the high-level driving potential VH in the P-MOS transistor PM2, a level shifter for raising the battery potential VB to the high-level pixel writing potential VL can be used as the level shifter LS2. Accordingly, the level shifter LS2 can be constructed without having to use a high-voltage transistor, so the size of the level shifter LS2 can also be reduced. Furthermore, because the P-MOS transistor PM3 of the third switching circuit SC3 receives only the battery potential VB being the minimum voltage in the power supply system, a level shifter is not necessary.

Figure 18A:
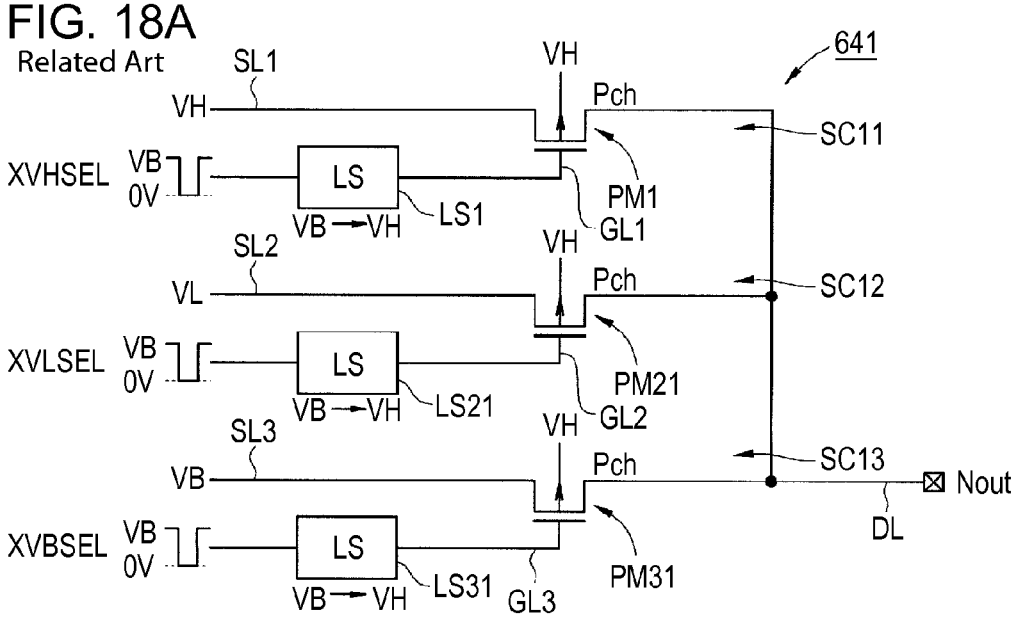
FIG. 18A Related Art
FIGS. 18A and 18B illustrate voltage selection circuits being examples in the related art.
Figure 18B:
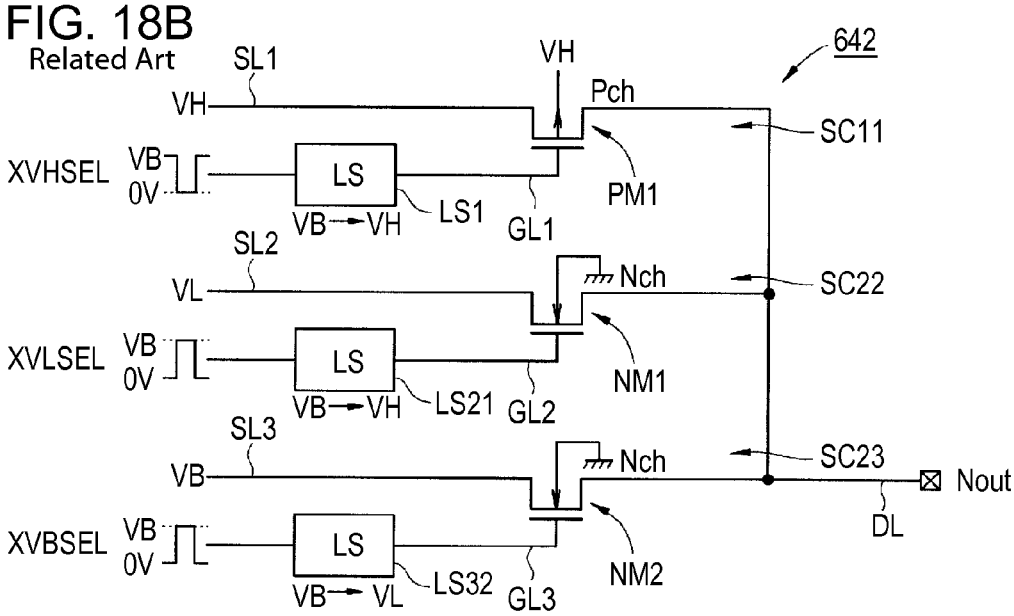
FIG. 18B Related Art

In such a way, in the voltage selection circuit 64*a*, a high-voltage transistor, which inevitably has a large size, is required for only the first switching circuit SC1, and the number of level shifters is smaller than that of each of the voltage selection circuits 641 and 642 illustrated in FIGS. 18A and 18B. Accordingly, the circuitry area can be reduced. Because the number of high-voltage transistors, which have a large leakage current, is small, the leakage current in circuitry as a whole can be reduced, and thus power consumption can be decreased.

A diode can typically be smaller in size than a transistor and has a small leakage current. Accordingly, the voltage selection circuit 64*a*, which includes the diodes D1 and D2, has a smaller circuitry area and a smaller leakage current than those in a configuration in which the P-MOS transistor PM3 of the third switching circuit SC3 is a high-voltage transistor. In addition, because the structure of a diode is typically simple, the number of layout man-hours is smaller than that in the case where a transistor is disposed instead of a diode.

However, because the diode has a forward voltage Vf, a voltage drop of approximately 0.2 to 0.6 V may occur depending on the current passing through the diode. To address this, it is preferable that the high-level pixel writing potential VL to be input to the second switching circuit SC2 be set at a relatively high value to estimate the amount of such a voltage drop. For example, when 5 V is necessary as the high-level pixel writing potential VL in the output terminal Nout, the high-level pixel writing potential VL supplied to the voltage selection circuit 64*a* may preferably be approximately 5.5 V. It is noted that if there is no problem in an operation of writing an image signal to the latch circuit 70 even when the above voltage drop occurs, no adjustment of an input potential may be performed.

The third switching circuit SC3 may also have a voltage drop occurring in the diode D2. The battery potential VB output from the third switching circuit SC3 is used in only maintaining a potential in image retaining step ST3, which will be described below. Because almost no current passes through the latch circuit 70 being in a stable state, a current passing through the diode D2 is considered to be small. Accordingly, the forward voltage Vf, which depends on the forward current, is also considered to be small, so no voltage drop causing a loss of the contents stored in the latch circuit 70 is considered to occur. However, even if a voltage drop is small, when the potential of the latch circuit 70 cannot be maintained, it is necessary to take measures, for example, setting an input potential at a relatively high value, as in the case of the second switching circuit SC2.

Driving Method

Figure 8:
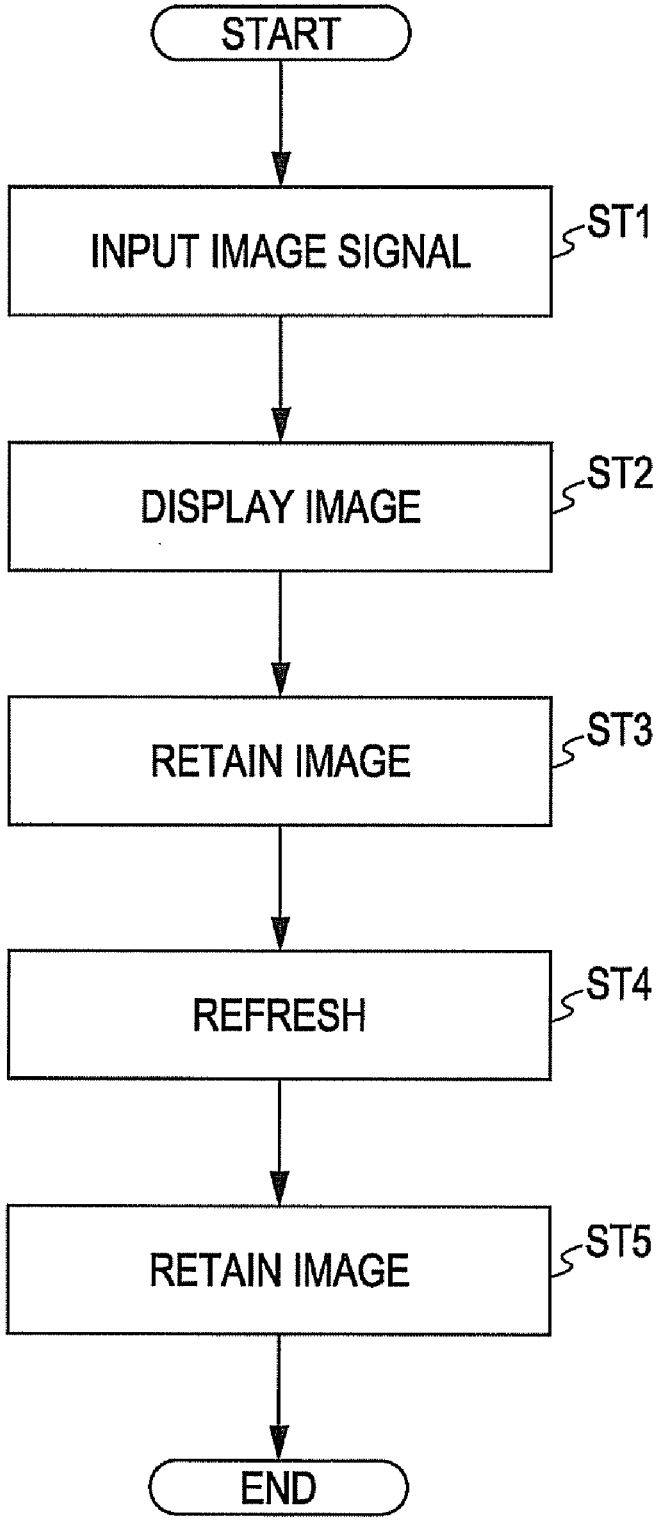
FIG. 8 is a flowchart that illustrates a driving method according to the first embodiment.

A method for driving the electrophoretic display apparatus 100 having the above-described configuration will be described next. FIG. 8 is a flowchart that illustrates a method for driving the electrophoretic display apparatus 100. As illustrated in FIG. 8, the method for driving the electrophoretic display apparatus 100 according to the present embodiment includes an image-signal inputting step ST1 of inputting an image signal into the latch circuit 70 of the pixel 40 (image-signal input period), an image displaying step ST2 of displaying an image based on the written image signal on the display section 5 (image display period), a first image retaining step ST3 of retaining the displayed image (image retaining period), a refreshing step ST4 of recovering the contrast of the displayed image (refresh period), and a second image retaining step ST5 (image retaining period).

Figure 9:
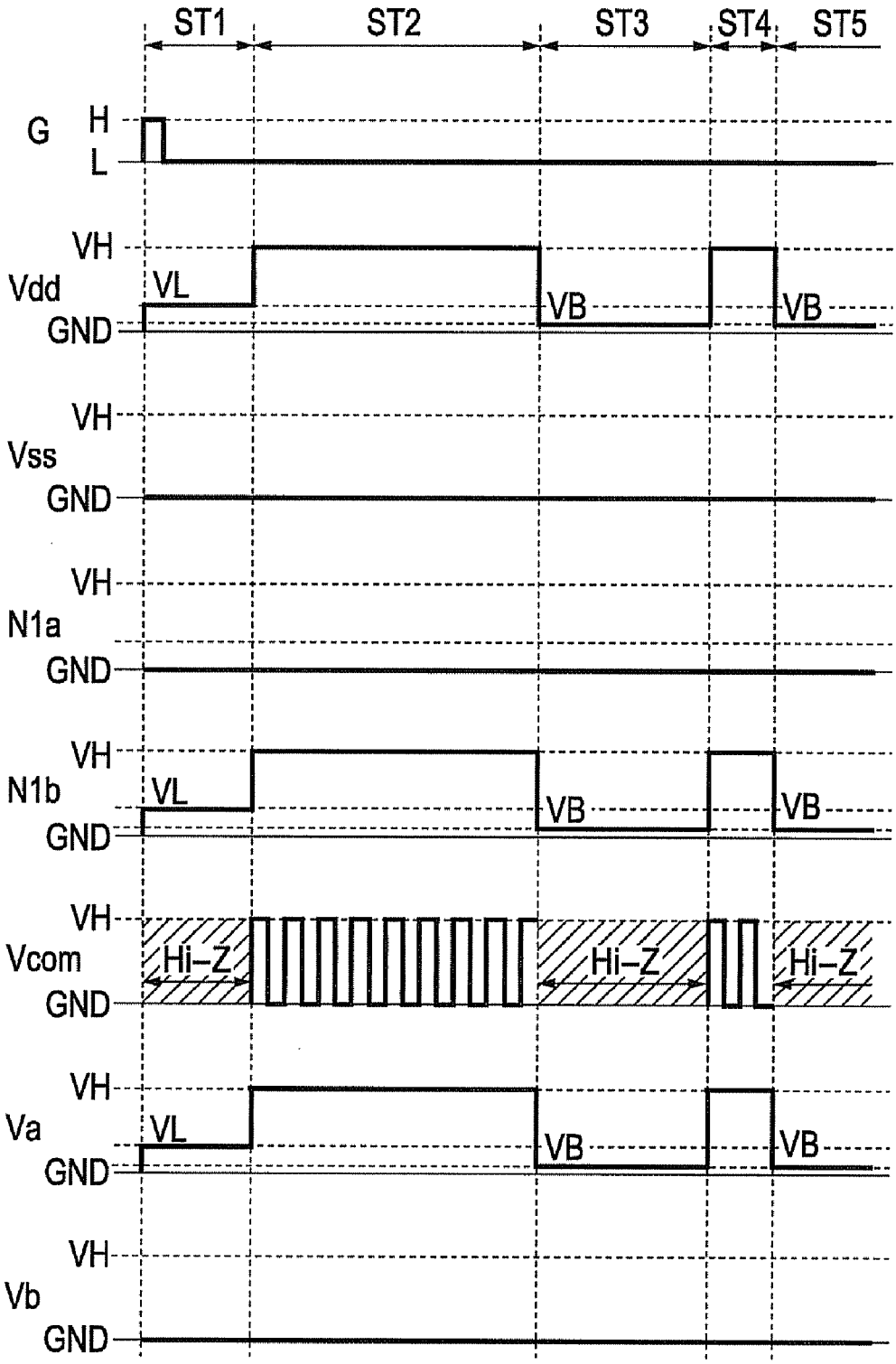
FIG. 9 is a timing diagram in the driving method according to the first embodiment.
Figure 10:
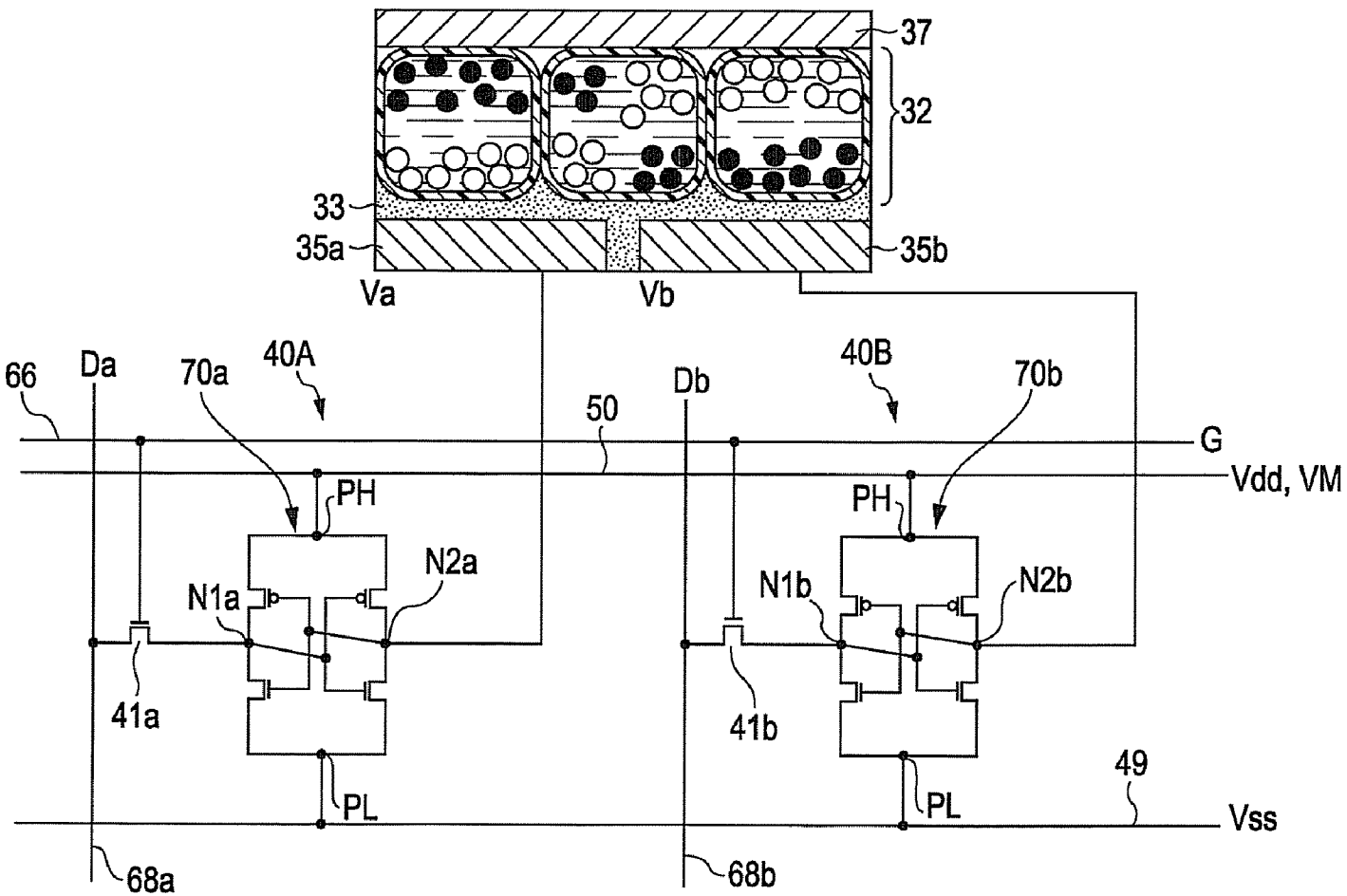
FIG. 10 is an illustration for use in describing the driving method according to the first embodiment.

FIG. 9 is a timing diagram corresponding to FIG. 8. FIG. 10 illustrates two pixels 40A and 40B used in the description below. The suffixes "A," "B," "a," and "b" of references used in FIGS. 9 and 10 are added merely for the purpose of differentiating between the two pixels 40 (40A and 40B) being an object of the description and between the components belonging to these pixels, nothing more than that.

FIG. 9 shows the potential G of the scan line 66, the potential Vdd of the high-potential power-supply line 50, the potential Vss of the low-potential power-supply line 49, the potential of a data input terminal N1*a* of a latch circuit 70*a*, the potential of a data input terminal N1*b* of a latch circuit 70*b*, the potential Vcom of the common electrode 37, the potential Va of a pixel electrode 35*a*, and the potential Vb of a pixel electrode 35*b*. The pixel 40A illustrated in FIG. 10 indicates a pixel subjected to black display in the image displaying step, which will be described below; the pixel 40B indicates a pixel subjected to white display.

The driving method according to the present embodiment will now be described below. First, in the image-signal inputting step ST1, the high-level pixel writing potential VL (e.g., 5 V) is supplied to the high-potential power-supply line 50 (Vdd). That is, in the voltage selection circuit 64*a* illustrated in FIG. 7A, the switching signal XVLSEL (low level) for turning on only the second switching circuit SC2 is input, and the high-level pixel writing potential VL is input from the output terminal Nout to the high-potential power-supply line 50. The ground potential GND (0 V; low level) is being input to the low-potential power-supply line 49 (Vss). The common electrode 37 is in a high-impedance state.

In the controller 63, the image data D input to the data buffer 164 is supplied to the memory control circuit 166 by the control circuit 161. The memory control circuit 166 loads the image data D into the frame memory 165. Thus, a preparation for displaying an image based on the image data D on the display section 5 is completed.

Then, as illustrated in FIG. 9, an image signal is input to the latch circuit 70 of each of the pixels 40. That is, a high-level (H) pulse being a selection signal is input to the scan line 66, and the driving TFT 41 connected to that scan line 66 is turned on. This connects the data line 68 and the latch circuit 70, and the image signal supplied from the frame memory 165 is input to the latch circuit 70.

In the pixel 40A, a low-level (ground potential GND; 0 V) image signal corresponding to black display (pixel data '0') is input from a data line 68*a* to the latch circuit 70*a* through a driving TFT 41*a*. Thus, the potential of the data input terminal N1*a* of the latch circuit 70*a* is the ground potential GND, and the potential of a data output terminal N2*a* is the high-level pixel writing potential VL. In the pixel 40B, a high-level (high-level pixel writing potential VL) image signal corresponding to white display (pixel data '1') is input from a data line 68*b* to the latch circuit 70*b* through a driving TFT 41*b*. Thus, the potential of the data input terminal N1*b* of the latch circuit 70*b* is the high-level pixel writing potential VL, and the potential of a data output terminal N2*b* is the ground potential GND (low level).

In the image-signal inputting step ST1, the potential Va of the pixel electrode 35*a* connected to the latch circuit 70*a* is the high-level pixel writing potential VL, and the potential Vb of the pixel electrode 35*b* connected to the latch circuit 70*b* is the ground potential GND. However, because the common electrode 37 is in a high-impedance state, the display state of the electrophoretic element 32 remains unchanged.

When an image signal is input to each of the pixels 40A and 40B, flow proceeds to the image displaying step ST2. In the image displaying step ST2, the potential Vdd of the high-potential power-supply line 50 is raised from the high-level pixel writing potential VL (e.g., 5 V) to the high-level driving potential VH (e.g., 15 V) for driving the electrophoretic element 32. That is, in the voltage selection circuit 64*a*, the second switching circuit SC2 is turned off, and the first switching circuit SC1 is turned on. The high-level driving potential VH is input from the output terminal Nout to the high-potential power-supply line 50. The potential Vss of the low-potential power-supply line 49 is the ground potential GND (0 V). Rectangular pulses that repeat the high-level driving potential VH and the ground potential GND in predetermined periods are input to the common electrode 37.

Thus, in the pixel 40A, the potential of the data output terminal N2*a* of the latch circuit 70*a* rises to the high-level driving potential VH, and the potential Va of the pixel electrode 35*a* becomes the high-level driving potential VH. During periods for which the common electrode 37 receiving the rectangular pulses is at the ground potential GND, the electrophoretic element 32 is driven by the potential difference between the pixel electrode 35*a* and the common electrode 37. That is, as illustrated in FIG. 5B, the positively charged black particles 26 are attracted toward the common electrode 37, whereas the negatively charged white particles 27 are attracted toward the pixel electrode 35*a*. In such a way, the pixel 40A is subjected to black display.

In the pixel 40B, because the potential of the data output terminal N2*b* of the latch circuit 70*b* is the ground potential GND, the potential Vb of the pixel electrode 35*b* is also the ground potential GND. During periods for which the common electrode 37 is at the high-level driving potential VH, the electrophoretic element 32 is driven by the potential difference between the pixel electrode 35*b* and the common electrode 37. That is, as illustrated in FIG. 5A, the negatively charged white particles 27 are attracted toward the common electrode 37, whereas the positively charged black particles 26 are attracted toward the pixel electrode 35*b*. In such a way, the pixel 40B is subjected to white display.

Through a series of operations in the image-signal inputting step ST1 and the image displaying step ST2, an image based on the image data D can be displayed on the display section 5.

When the image displaying operation has been completed, as illustrated in FIG. 8, flow proceeds to the first image retaining step ST3. In the first image retaining step ST3, the common electrode 37 is in a high-impedance state. In the voltage selection circuit 64*a*, the first switching circuit SC1 is turned off, and the third switching circuit SC3 is turned on. Thus, the high-potential power-supply terminal PH of the latch circuit 70 is lowered from the high-level driving potential VH to the battery potential VB. That is, the latch circuit 70 maintains its power-supply ON state driven by the battery potential VB (e.g., 2 V) and retains the image signal input in the image-signal inputting step ST1.

In the first image retaining step ST3, because the latch circuit 70 retains its potential, the potential Va of the pixel electrode 35*a* is the battery potential VB, and the potential Vb of the pixel electrode 35*b* is the ground potential GND. However, because the common electrode 37 is in a high-impedance state, the electrophoretic element 32 is not driven. Accordingly, in the first image retaining step ST3, the display of the display section 5 remains unchanged. This is the same as in the second image retaining step ST5.

After flow proceeded to the first image retaining step ST3, when a predetermined period of time has elapsed, flow proceeds to the refreshing step ST4. In the refreshing step ST4, in the voltage selection circuit 64*a*, the third switching circuit SC3 is turned off, and the first switching circuit SC1 is turned on. Thus, as illustrated in FIG. 9, the potential Vdd of the high-potential power-supply line 50 is raised to the high-level driving potential VH again. Rectangular pulses that repeat the high-level driving potential VH and the ground potential GND in predetermined periods are input to the common electrode 37.

Then, during periods for which the common electrode 37 is at the ground potential GND, the electrophoretic element 32 is driven on the basis of the potential difference between the pixel electrode 35 (35*a*) and the common electrode 37, and that pixel 40 (40A) is subjected to black display. This black display operation enables the contrast decreasing with the passage of time in the pixel 40 (40A) being subjected to black display to be recovered to a state immediately after the image displaying step ST2. During periods for which the common electrode 37 is at the high-level driving potential VH, the electrophoretic element 32 is driven on the basis of the potential difference between the pixel electrode 35 (35*b*) and the common electrode 37, and that pixel 40 (40B) is subjected to white display. This white display operation enables the contrast decreasing with the passage of time in the pixel 40 (40B) being subjected to white display to be recovered to a state immediately after the image displaying step ST2.

In the refreshing step ST4 illustrated in FIG. 9, pulses of two periods are input to the common electrode 37. However, the pulses input to the common electrode 37 in the refreshing step ST4 may have any periods as long as at least one high-level driving potential VH period and at least one ground potential GND period exist. For example, the pulses may also be longer than two periods.

After the contrast of the displayed image is recovered in the refreshing step ST4, flow proceeds to the second image retaining step ST5. The power supply voltage of the latch circuit 70 is lowered to the battery potential VB (high level) again, thus enabling the image signal to be retained with the minimum power consumption. In this state, the common electrode 37 is made to become a high-impedance state, and the displayed image is retained over a long period of time. After that, the refreshing step ST4 and the image retaining step ST5 (ST3) of a predetermined period are repeated alternately. Thus, the contrast of a displayed image can be retained.

With the driving method according to the present embodiment, as described in detail above, the provision of the first image retaining step ST3 and the refreshing step ST4 after the image displaying step ST2 enables a displayed image to be retained over a long period of time without decreasing the contrast. In addition, because an operating state is maintained without turning off of the power supply of the latch circuit 70 in the first image retaining step ST3, a refresh operation can be performed without a re-input of an image signal into the latch circuit 70. Accordingly, power consumption caused by a transfer of an image signal can be eliminated. Furthermore, because in the first image retaining step ST3 the potential Vdd of the high-potential power-supply terminal PH is lowered up to the battery potential VB and the driving voltage of the latch circuit 70 is lowered up to the minimum voltage of the electrophoretic display apparatus 100, the power consumption in the first image retaining step ST3 and the second image retaining step ST5 can be suppressed. Moreover, because the electrophoretic display apparatus 100 according to the present embodiment includes the voltage selection circuit 64*a* illustrated in FIG. 7A, the electrophoretic display apparatus 100 can freely supply the battery potential VB to the high-potential power-supply line 50.

The length of the first image retaining step ST3 is not limited to a particular one. The degree of decrease in contrast increases with an increase in the length of time, and this requires an increase in the length of time of driving the electrophoretic element 32 in the refreshing step ST4. The change in the contrast is increased by the refresh operation, and it tends to be visually identifiable noticeably. To address this, the length of the first image retaining step ST3 may preferably be set such that a refresh operation is performed when an excessive change in the contrast has not yet occur.

In the driving method according to the present embodiment, in the image displaying step ST2, rectangular pulses that repeat the high-level driving potential VH and the ground potential GND for a plurality of periods are input to the common electrode 37. Such a driving method is called "common oscillation driving" in the invention. The "common oscillation driving" is defined as a driving method in which pulses that repeat the high-level driving potential VH (high level) and the ground potential GND (low level) is applied to the common electrode 37 at least for one period in the image displaying step ST2.

With this common oscillation driving method, because the black particles and white particle can be moved to a desired electrode more reliably, the contrast can be enhanced. Because potentials applied to the pixel electrode and the common electrode can be controlled using two values of the high-level driving potential VH and the ground potential GND, the voltage used in the circuitry can be reduced, and the circuitry configuration can be simplified. When a TFT is used as the switching element of the pixel electrode 35, this is advantageous in that the reliability of the TFT can be ensured because of low voltage driving. It is preferable that the frequency and the number of periods of the common oscillation driving be determined according to the specifications and characteristics of the electrophoretic element 32.

In the invention, a driving method in which the common oscillation driving is not performed in the image displaying step ST2 may also be used. In this case, the image displaying step ST2 is divided into a black image displaying section and a white image displaying section. In the black image displaying section, the common electrode 37 is fixed at the ground potential GND. In the white image displaying section, the common electrode 37 is fixed at the high-level driving potential VH. Thus, the pixel 40A is subjected to black display in the black image displaying section, whereas the pixel 40B is subjected to white display in the white image displaying section. Accordingly, an image can be displayed in substantially the same manner as in the above-described embodiment.

Second Embodiment

Figure 11:
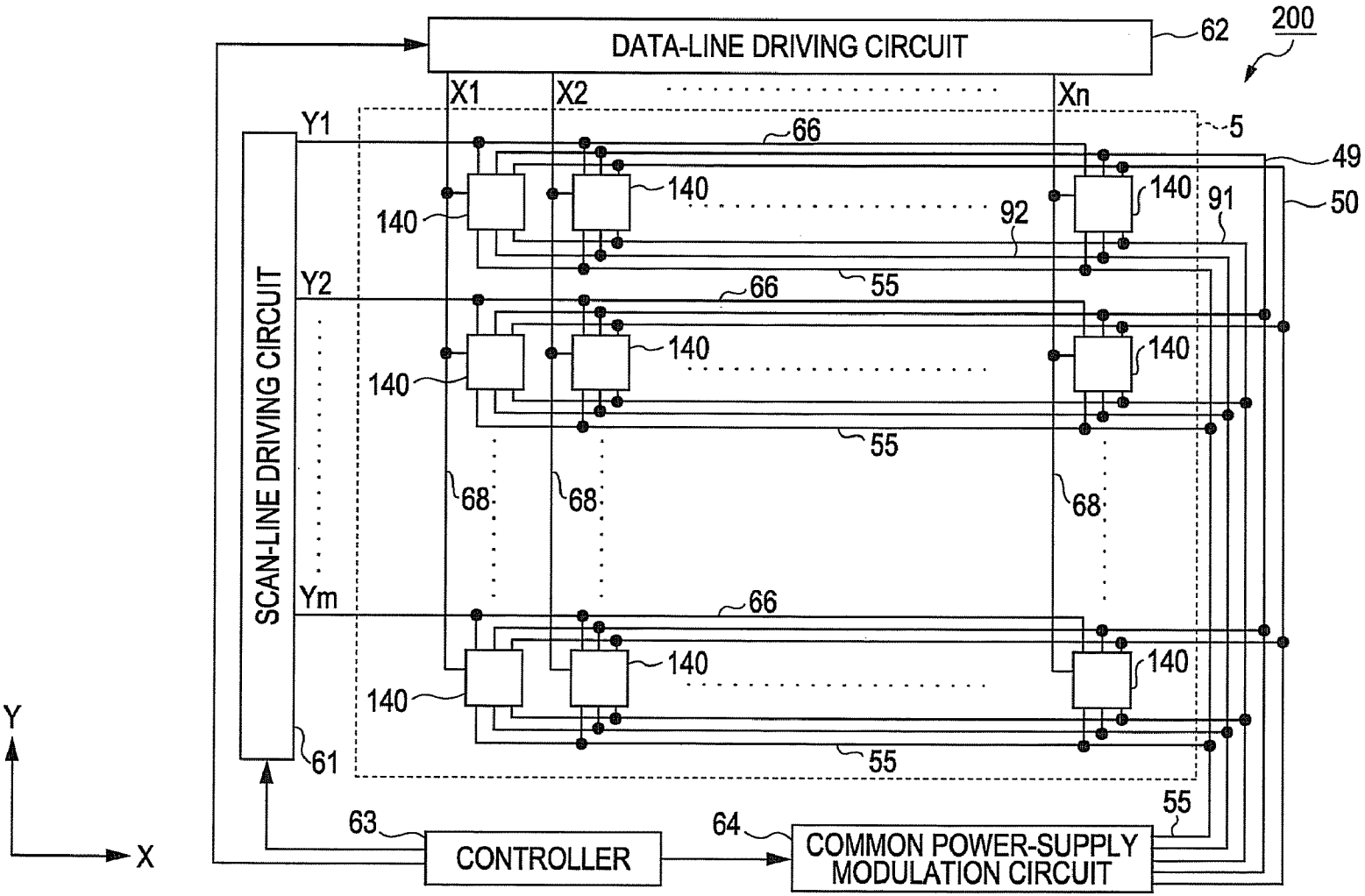
FIG. 11 illustrates a schematic configuration of an electrophoretic display apparatus according to a second embodiment of the invention.
Figure 12:
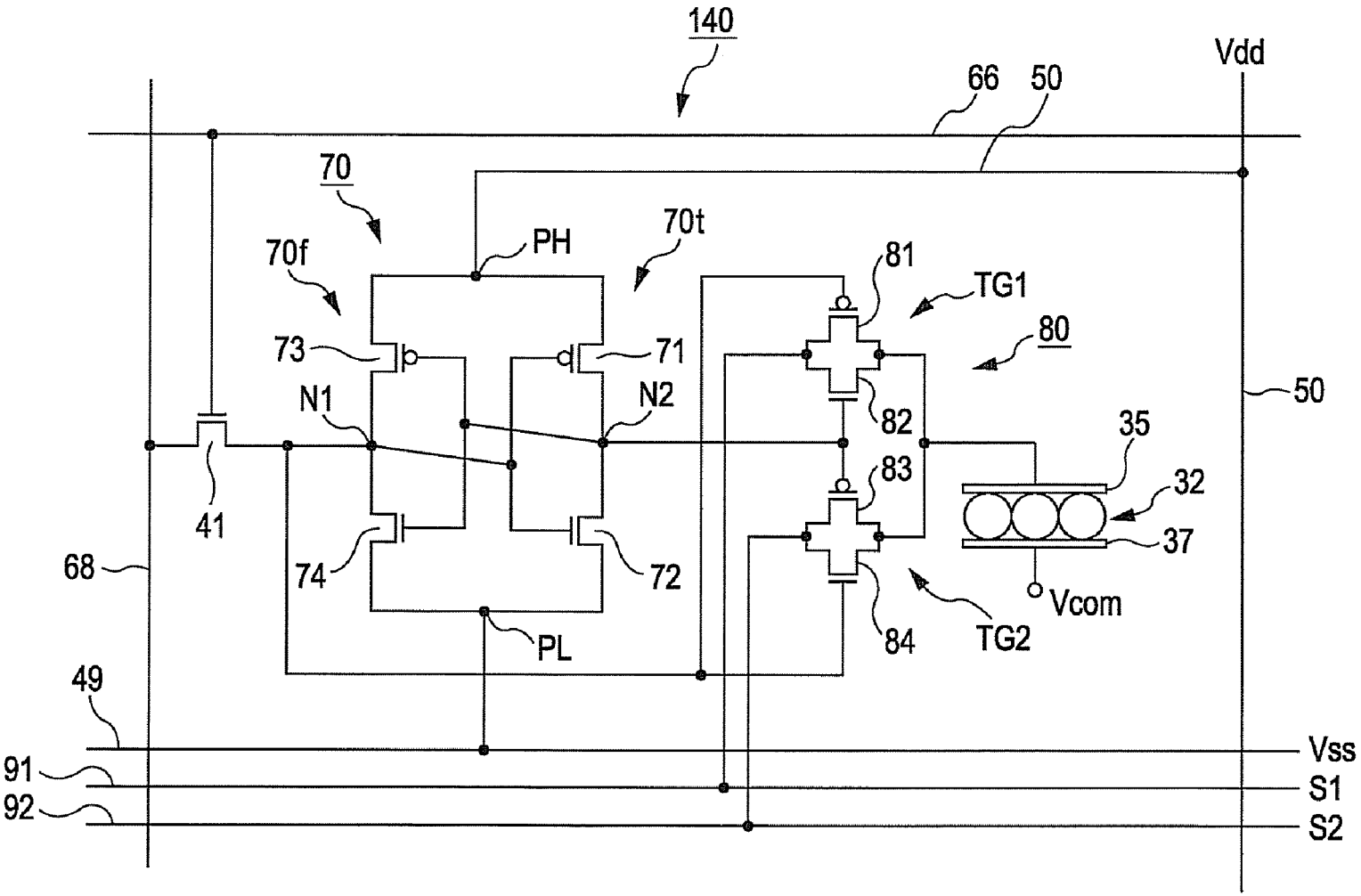
FIG. 12 is a schematic circuit diagram of a pixel of the electrophoretic display apparatus according to the second embodiment.

A second embodiment of the invention is described below with reference to the drawings. FIG. 11 illustrates a schematic configuration of an electrophoretic display apparatus 200 according to the second embodiment. FIG. 12 illustrates a schematic circuit diagram of a pixel included in the electrophoretic display apparatus 200 according to the second embodiment. In FIGS. 11 and 12, the same reference numerals are used in common components in the foregoing first embodiment, and the detailed description thereof is not repeated here.

As illustrated in FIG. 11, in the electrophoretic display apparatus 200, pixels 140 are arranged in a matrix in the display section 5. Each of the pixels 140 is connected to a first control line 91 and a second control line 92 extending from the common power-supply modulation circuit 64. The other lines (scan lines 66, data lines 68, common-electrode line 55, high-potential power-supply line 50, low-potential power-supply line 49) are the same as those in the first embodiment.

As illustrated in FIG. 12, the pixel 140 in the electrophoretic display apparatus 200 includes a switching circuit 80 disposed between the latch circuit 70 and the pixel electrode 35, in addition to the configuration of the pixel 40 illustrated in FIG. 2. The switching circuit 80 includes a first transmission gate TG1 and a second transmission gate TG2.

The first transmission gate TG1 includes a P-MOS transistor 81 and an N-MOS transistor 82. The source terminal of each of the P-MOS transistor 81 and the N-MOS transistor 82 is connected to the first control line 91. The drain terminal of each of the P-MOS transistor 81 and the N-MOS transistor 82 is connected to the pixel electrode 35. The gate terminal of the P-MOS transistor 81 is connected to the data input terminal N1 (the drain terminal of the driving TFT 41) of the latch circuit 70. The gate terminal of the N-MOS transistor 82 is connected to the data output terminal N2 of the latch circuit 70.

The second transmission gate TG2 includes a P-MOS transistor 83 and an N-MOS transistor 84. The source terminal of each of the P-MOS transistor 83 and the N-MOS transistor 84 is connected to the second control line 92. The drain terminal of each of the P-MOS transistor 83 and the N-MOS transistor 84 is connected to the pixel electrode 35. The gate terminal of the P-MOS transistor 83 is connected to the data input terminal N2 of the latch circuit 70. The gate terminal of the N-MOS transistor 84 is connected to the data output terminal N1 of the latch circuit 70.

To display an image on the display section 5 in the electrophoretic display apparatus 200 having the above-described configuration, an image signal is input to the data input terminal N1 of the latch circuit 70 through the driving TFT 41, and the image signal is stored as a potential in the latch circuit 70. Then, the switching circuit 80 operating on the basis of a potential output from the data input terminal N1 and the data output terminal N2 of the latch circuit 70 connects the pixel electrode 35 to the first control line 91 or the second control line 92. As a result, a potential corresponding to the image signal is input from the first control line 91 or the second control line 92 to the pixel electrode 35. Thus, as illustrated in FIG. 5, black or white display is performed on the pixel 140 on the basis of a potential difference between the pixel electrode 35 and the common electrode 37.

Figure 13:
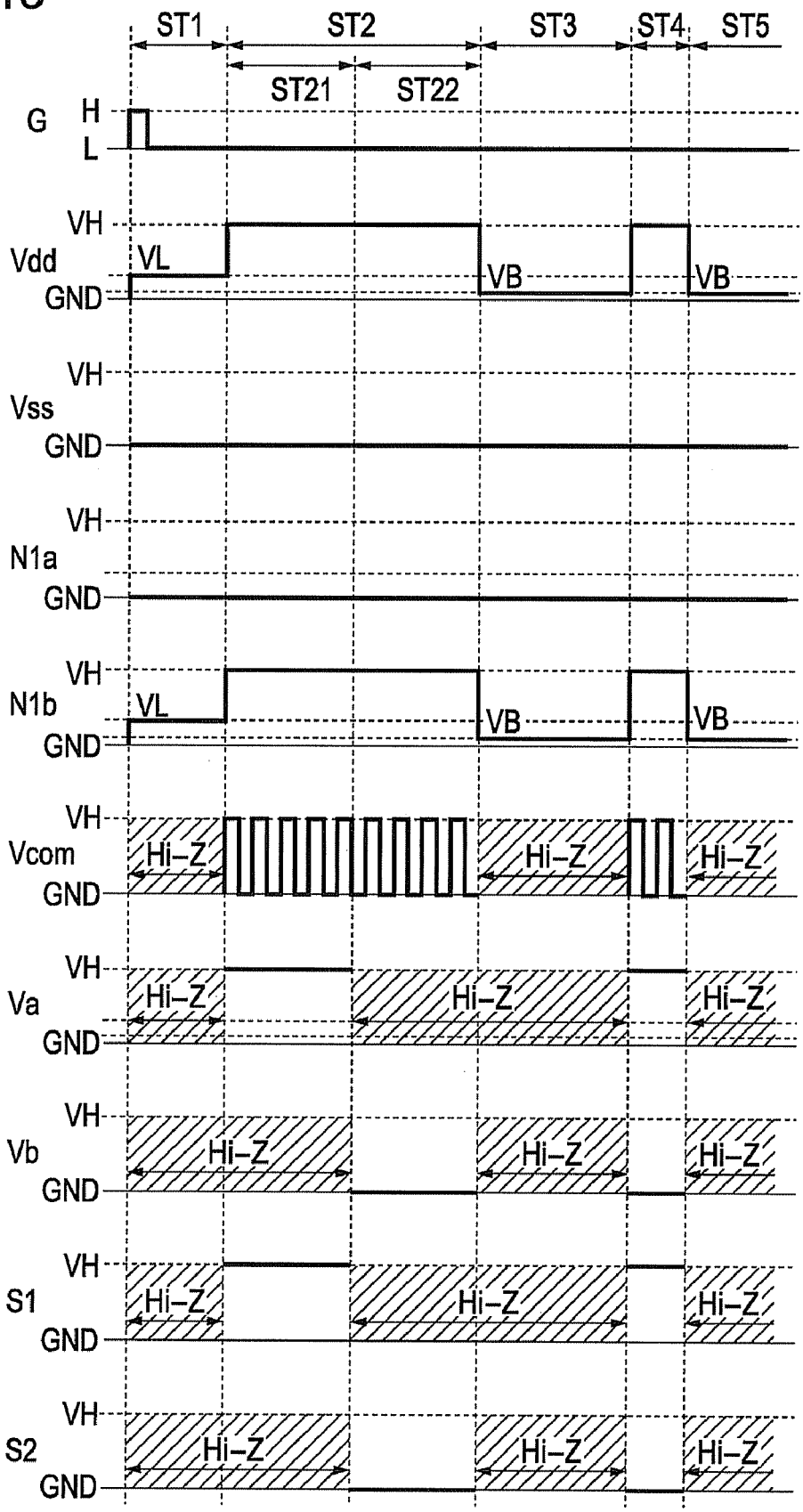
FIG. 13 is a timing diagram in a driving method according to the second embodiment.
Figure 14:
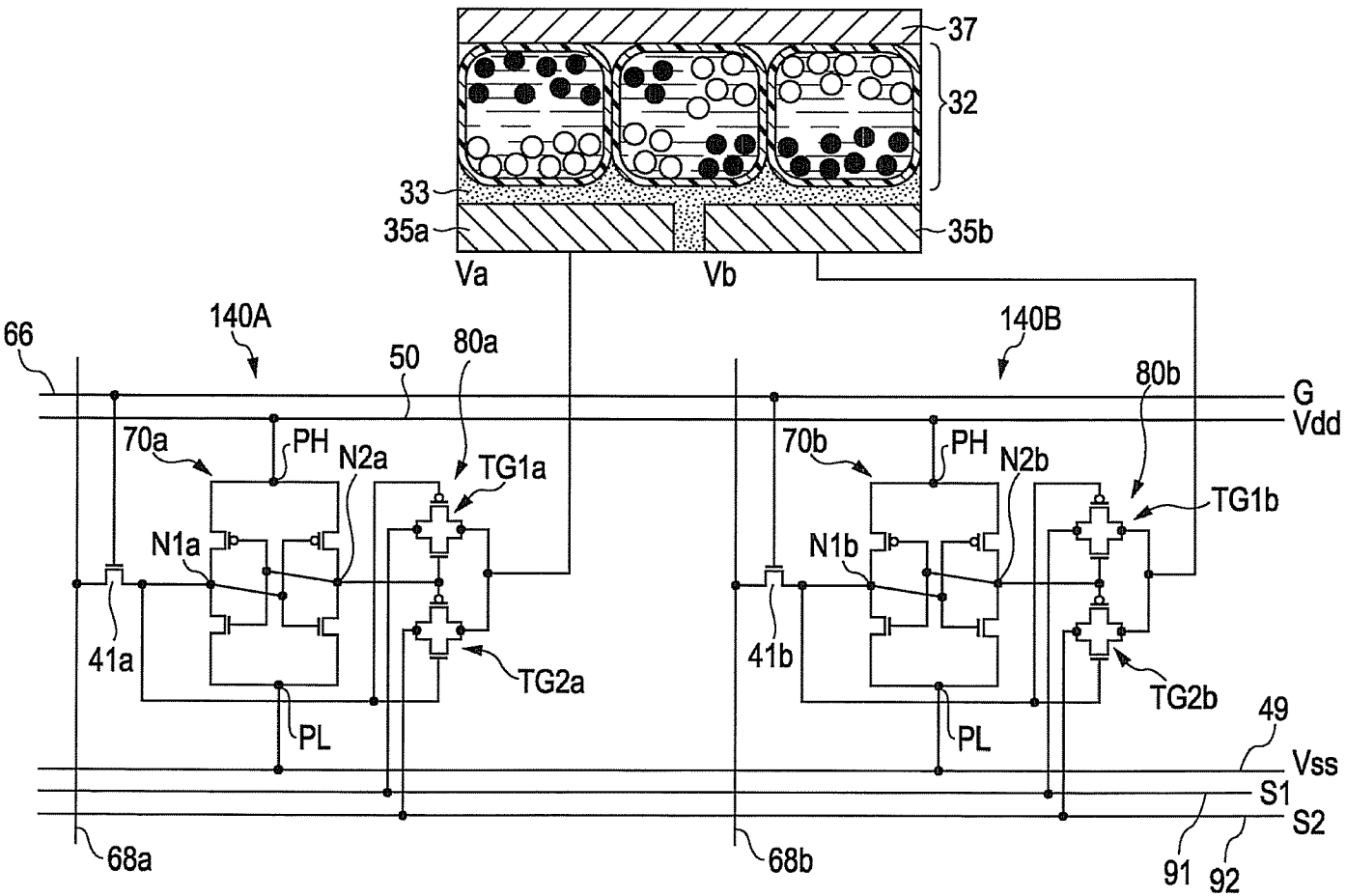
FIG. 14 is an illustration for use in describing the driving method according to the second embodiment.

FIG. 13 is a timing diagram in a method for driving the electrophoretic display apparatus 200 and corresponds to FIG. 9, which is referred to in the first embodiment. FIG. 14 illustrates a pixel 140A and a pixel 140B subjected to black display and white display, respectively, performed by the driving method illustrated in FIG. 13. FIG. 14 corresponds to FIG. 10, which is referred to in the first embodiment. FIG. 13 illustrates the potential S1 of the first control line 91 and the potential S2 of the second control line 92, in addition to the timing diagram illustrated in FIG. 9.

The driving method according to the first embodiment illustrated in FIG. 8 can also be used in the electrophoretic display apparatus 200 according to the second embodiment. That is, the driving method sequentially performing the image-signal inputting step ST1 of inputting an image signal to the latch circuit 70 of the pixel 140, the image displaying step ST2 of displaying an image based on the written image signal on the display section 5, the first image retaining step ST3 of retaining the displayed image, the refreshing step ST4 of recovering the contrast of the displayed image, and the second image retaining step ST5 can also be used.

It is noted that the driving method according to the present embodiment is a driving method in which the image displaying step ST2 is divided into a black image displaying step ST21 and a white image displaying step ST22 and black display and white display are performed in the respective periods to display an image on the display section 5.

In the black image displaying step ST21, the high-level driving potential VH is input to the first control line 91, whereas the second control line 92 is in a high-impedance state. Thus, the potential Va of the pixel electrode 35*a* of the pixel 140A is the high-level driving potential VH, whereas the pixel electrode 35*b* of the pixel 140B is in a high-impedance state. Accordingly, only the electrophoretic element 32 belonging to the pixel 140A is driven, and the pixel 140A is subjected to black display.

In the white image displaying step ST22, the first control line 91 is in a high-impedance state, whereas the ground potential GND is input to the second control line 92. Thus, the potential Vb of the pixel electrode 35*b* of the pixel 140B is the ground potential GND, whereas the pixel electrode 35*a* of the pixel 140A is in a high-impedance state. Accordingly, only the electrophoretic element 32 belonging to the pixel 140B is driven, and the pixel 140B is subjected to white display. In such a way, an image based on image data is displayed on the display section 5.

With the above-described driving method, in the image displaying step ST2, either one of the first control line 91 and the second control line 92 is always in a high-impedance state. Accordingly, the potential difference between the neighboring pixel electrodes 35*a* and 35*b* can prevent a leakage current occurring through the adhesive layer 33 and the microcapsule 20. Therefore, the electrophoretic display apparatus having a more enhanced power-saving feature can be achieved.

In the present embodiment, both the first control line 91 and the second control line 92 are in a high-impedance state in the image retaining step ST3 and ST5. Thus, the pixel electrode 35 electrically connected to either one of the first control line 91 and the second control line 92 depending on the output of the latch circuit 70 is also in a high-impedance state. Accordingly, the occurrence of a leakage current is suppressed also in the image retaining step ST3 and ST5.

In the electrophoretic display apparatus 200 according to the present embodiment, because a voltage to be applied to the pixel electrode 35 is supplied from the first control line 91 or the second control line 92, a potential is input to both the first control line 91 and the second control line 92 in the refreshing step ST4. Because the length of the refreshing step ST4 is short, even when the potential is input to both the first control line 91 and the second control line 92, as illustrated in FIG. 13, a leakage current is considered to be less likely to occur. However, to prevent a leakage current with more stability, it is preferable that the refreshing step ST4 be divided into a black image displaying step and a white image displaying step, similar to the image displaying step ST2, a potential be input to either one of the first control line 91 and the second control line 92 in each of the steps, and the other control line be in a high-impedance state.

In the electrophoretic display apparatus 200 according to the present embodiment, because the switching circuit 80 is disposed between the latch circuit 70 and the pixel electrode 35, the display of the display section 5 can be controlled independently of the potential stored in the latch circuit 70 by manipulation of the potential of the first control line 91 and the second control line 92 connected to the switching circuit 80.

For example, when the high-level driving potential VH is input to both the first control line 91 and the second control line 92, the high-level driving potential VH can be input to the pixel electrodes 35 of all of the pixels 140. In such a state, when the ground potential GND (low level) is input to the common electrode 37, black display can be performed on the whole surface of the display section 5. When the ground potential GND (low level) is input to both first control line 91 and the second control line 92 and the high-level driving potential VH is input to the common electrode 37, white display is performed on the whole surface of the display section 5. Accordingly, with the present embodiment, an erasing operation for the display section 5 can be performed without having to transfer an image signal to the latch circuit 70.

Electronic Device

Figure 15:
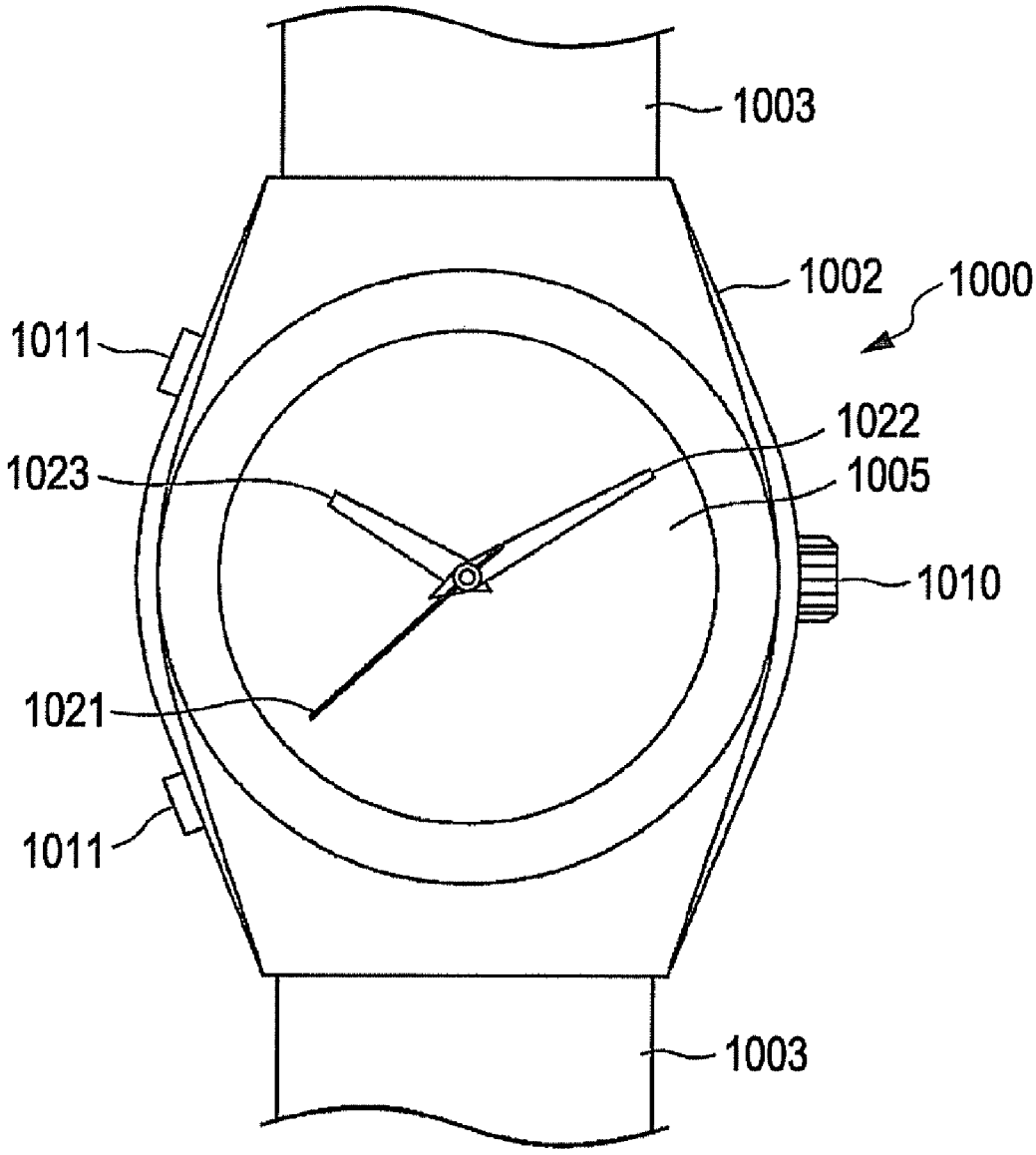
FIG. 15 illustrates a wristwatch that is one example of an electronic device.

Examples of an electronic device in which at least one of the electrophoretic display apparatus 100 and the electrophoretic display apparatus 200 according to the above-described embodiments is used are described below. FIG. 15 is a front view of a wristwatch 1000. The wristwatch 1000 includes a watch casing 1002 and a pair of bands 1003 connected to the watch casing 1002. The wristwatch 1000 further includes a display section 1005 including the electrophoretic display apparatus 100 (200) according to the above-described embodiment, a second hand 1021, a minute hand 1022, and a hour hand 1023 at the frontal side of the watch casing 1002. The wristwatch 1000 further includes a crown 1010 and an operating button 1011 being operating portions at the lateral side of the watch casing 1002. The crown 1010 is connected to a stem (not shown) disposed inside the casing, and it can be freely pulled out or pushed back at multiple (e.g., two) stages and freely rotated integrally with the stem. In the display section 1005, an image serving as the background, a character string representing date and time, a second hand, a minute hand, and a hour hand can be displayed.

Figure 16:
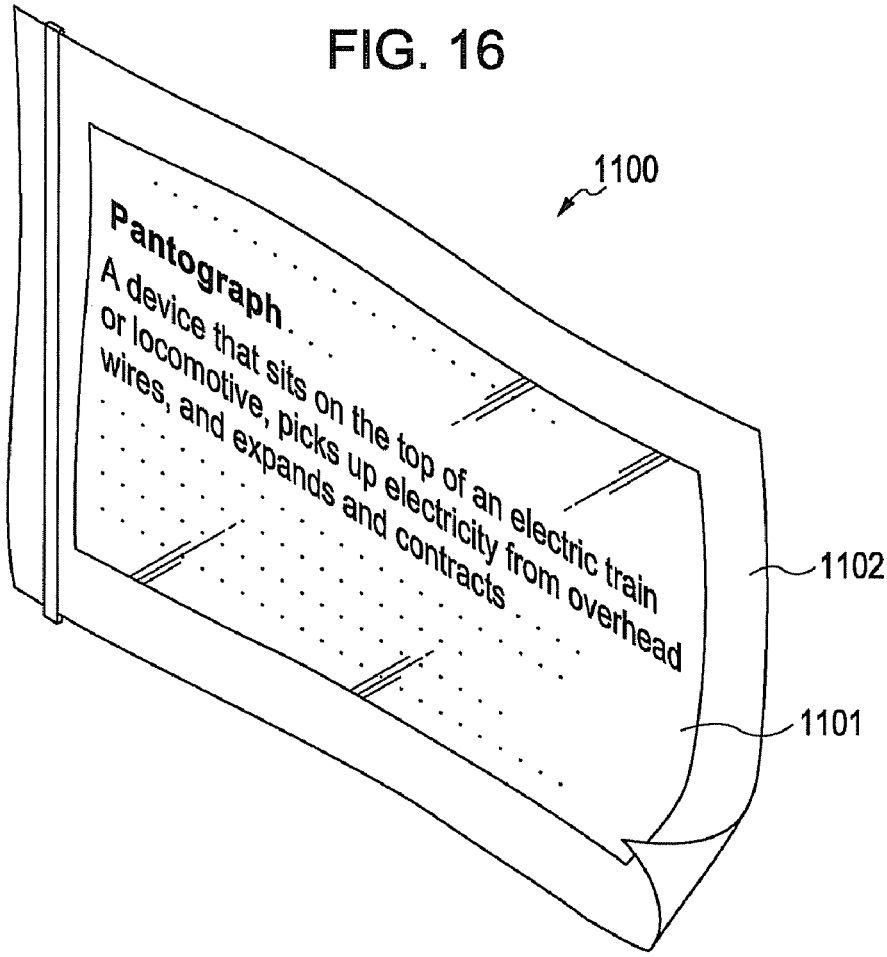
FIG. 16 illustrates a sheet of electronic paper that is another example of the electronic device.

FIG. 16 is a perspective view that illustrates a configuration of electronic paper 1100. The electronic paper 1100 includes the electrophoretic display apparatus 100 (200) according to the above-described embodiment in a display region 1101. The electronic paper 1100 is flexible and is constructed so as to include a body 1102 composed of a sheet having substantially the same textures and flexibility as in traditional paper.

Figure 17:
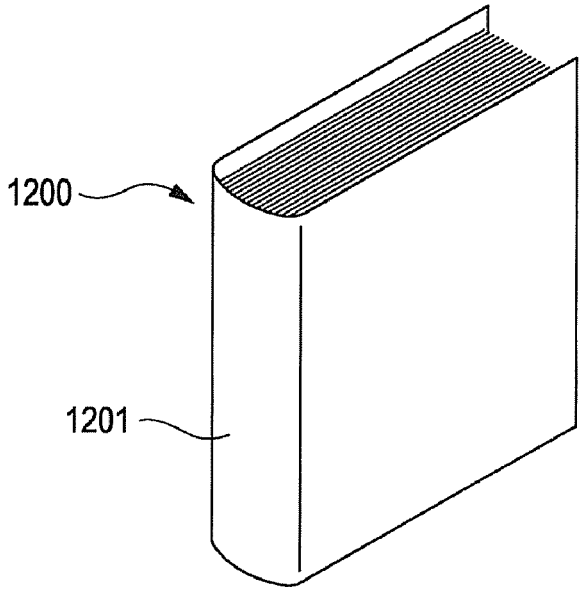
FIG. 17 illustrates an electronic notebook that is still another example of the electronic device.

FIG. 17 is a perspective view that illustrates a configuration of an electronic notebook 1200. The electronic notebook 1200 is the one in which a plurality of sheets of the electronic paper 1100 bound are sandwiched by a cover 1201. The cover 1201 includes a display-data inputting unit (not shown) for inputting display data transmitted from, for example, an external apparatus. Thus, depending on the display data, the displayed details can be changed and updated while the sheets of electronic paper are bound.

Each of the wristwatch 1000, the electronic paper 1100, and the electronic notebook 1200, which are described above, is an electronic device that includes a display section having an enhanced power-saving feature because it uses the electrophoretic display apparatus 100 (200) according to the above-described embodiment in the display section. The illustrated electronic devices are merely examples of an electronic device of the invention and are not intended to limit the technical scope of the invention. For example, the electrophoretic display apparatus according to an aspect of the invention can also be suitably used in a display section of another electronic device, such as a cellular phone or a portable audio device.

The entire disclosure of Japanese Patent Application No. 2008-076528, filed Mar. 24, 2008 is expressly incorporated by reference herein.

What is claimed is:

1. A voltage selection circuit for outputting a potential selected from a plurality of input potentials, the voltage selection circuit capable of selectively outputting a first high-level potential being a highest potential, a second high-level potential, or a third high-level potential being a lowest potential from an output terminal thereof, the voltage selection circuit comprising:

a first switching circuit that supplies the first high-level potential to the output terminal;

a second switching circuit that supplies the second high-level potential to the output terminal; and a third switching circuit that supplies the third high-level potential to the output terminal, wherein the first switching circuit includes a high-voltage transistor and a first level shifter connected to a first gate terminal of the high-voltage transistor, wherein the second switching circuit includes a first low-voltage transistor, a second level shifter connected to a second gate terminal of the first low-voltage transistor, and a first diode disposed between the first low-voltage transistor and the output terminal, and wherein the third switching circuit includes a second low-voltage transistor and a second diode disposed between the second low-voltage transistor and the output terminal.

2. The voltage selection circuit according to claim 1, wherein the second level shifter includes a third low-voltage transistor.

3. An electrophoretic display apparatus comprising:

two substrates;

an electrophoretic element containing an electrophoretic particle and being sandwiched between the two substrates; and a display portion including a plurality of pixels, wherein each of the plurality of pixels includes a pixel electrode, a pixel switching element, and a latch circuit connected between the pixel electrode and the pixel switching element, and wherein at least a power supply voltage of the latch circuit is supplied from the voltage selection circuit according to claim 1.

4. The electrophoretic display apparatus according to claim 3, wherein the third high-level potential is a voltage of a battery in a power supply system of the electrophoretic display apparatus.

5. An electronic device comprising the electrophoretic display apparatus according to claim 3.

6. An electrophoretic display apparatus comprising:

two substrates;

an electrophoretic element containing an electrophoretic particle and being sandwiched between the two substrates; and a display portion including a plurality of pixels, wherein each of the plurality of pixels includes a pixel electrode, a pixel switching element, and a latch circuit connected between the pixel electrode and the pixel switching element, and wherein at least a power supply voltage of the latch circuit is supplied from a voltage selection circuit for outputting a potential selected from a plurality of input potentials to an output terminal, the voltage selection circuit capable of selectively outputting a first high-level potential being a highest potential, a second high-level potential, or a third high-level potential being a lowest potential from an output terminal thereof, the voltage selection circuit including:

a first switching circuit that supplies the first high-level potential to the output terminal;

a second switching circuit that supplies the second high-level potential to the output terminal; and a third switching circuit that supplies the third high-level potential to the output terminal, wherein the first switching circuit includes a high-voltage transistor and a first level shifter connected to a first gate terminal of the high-voltage transistor, wherein the second switching circuit includes a first low-voltage transistor, a second level shifter connected to a second gate terminal of the first low-voltage transistor, and a first diode disposed between the first low-voltage transistor and the output terminal, and wherein the third switching circuit includes a second low-voltage transistor and a second diode disposed between the second low-voltage transistor and the output terminal.

* * * * *